US012716297B2

(12) United States Patent
Hay

(10) Patent No.: US 12,716,297 B2
(45) Date of Patent: Aug. 25, 2026

(54) COMPOSITE UMBILICAL FOR PULSE POWER BORING SYSTEM

(71) Applicant: Halliburton Energy Services, Inc., Houston, TX (US)

(72) Inventor: Charles Richard Hay, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 19/016,470

(22) Filed: Jan. 10, 2025

(65) Prior Publication Data

US 2026/0201753 A1 Jul. 16, 2026

(51) Int. Cl.

| | |
|---|---|
| ***E21B 7/15*** | (2006.01) |
| ***E21B 17/00*** | (2006.01) |
| ***E21B 19/00*** | (2006.01) |
| ***E21B 23/00*** | (2006.01) |

(52) U.S. Cl.
CPC ..... *E21B 7/15* (2013.01); *E21B 17/003* (2013.01); *E21B 19/008* (2013.01); *E21B 23/001* (2020.05)

(58) Field of Classification Search
CPC ..... E21B 7/15; E21B 17/003; E21B 19/008; E21B 19/22; E21B 23/001
See application file for complete search history.

(56) References Cited

U.S. PATENT DOCUMENTS 316,602 A * 4/1885 Carter ..... B66D 1/06 254/365
3,285,629 A * 11/1966 Cullen ..... E21B 19/22 285/119
3,467,206 A * 9/1969 Acheson ..... E21B 7/14 175/14
3,702,223 A * 11/1972 Acheson ..... E21B 37/00 175/103
4,367,917 A * 1/1983 Gray ..... G02B 6/448 385/102

(Continued)

FOREIGN PATENT DOCUMENTS

CA 2773632 A1 * 10/2013 ..... E21B 43/305
CN 117945777 A 4/2024

(Continued)

OTHER PUBLICATIONS

Foreign Communication from Related Application—International Search Report and Written Opinion of the International Searching Authority, International Application No. PCT/US2025/013783, dated Sep. 29, 2025, 13 pages.

*Primary Examiner* — Jennifer H Gay
(74) *Attorney, Agent, or Firm* — Conley Rose, P.C.; Rodney B. Carroll

(57) ABSTRACT

A system for well formation includes a first composite umbilical, a winding system configured to hold and dispense the first composite umbilical, a first surface feeder configured to feed the first composite umbilical from the winding system into a first wellbore, and a first bottom hole assembly coupled to the first composite umbilical and configured to receive electric power and a first communication signal via the first composite umbilical. The first bottom hole assembly includes a first tractor and a first pulse power electrode coupled to the first tractor.

20 Claims, 13 Drawing Sheets

(56) References Cited

U.S. PATENT DOCUMENTS 4,463,814 A * 8/1984 Horstmeyer ..... E21B 4/04 166/212
4,662,437 A * 5/1987 Renfro ..... E21B 36/04 166/248
5,176,364 A * 1/1993 Bell ..... B66D 1/46 254/291
6,296,066 B1 * 10/2001 Terry ..... G01V 3/30 175/320
6,857,486 B2 * 2/2005 Chitwood ..... E21B 43/103 114/328
7,347,257 B2 * 3/2008 Van Way ..... E21B 19/22 166/77.2
7,748,685 B2 * 7/2010 Richards ..... E21B 19/22 242/615
7,798,234 B2 * 9/2010 Ju ..... F16L 11/22 166/345
8,554,029 B2 10/2013 Zhang et al.
8,749,242 B2 * 6/2014 Clark ..... E21B 7/046 324/345
9,010,461 B2 * 4/2015 Hay ..... E21B 47/13 340/854.3
9,074,422 B2 * 7/2015 Grubb ..... B23K 26/1464
9,181,788 B2 * 11/2015 Ageev ..... H05H 1/52
9,828,846 B2 * 11/2017 Xia ..... E21B 17/00
10,060,195 B2 * 8/2018 Moeny ..... E21B 17/003
10,145,231 B2 * 12/2018 Donderici ..... E21B 7/04
11,127,512 B2 * 9/2021 Sangar ..... H01B 7/046
11,346,196 B2 * 5/2022 Saltykov ..... E21B 43/26
11,414,935 B2 * 8/2022 Nesgaard ..... E21B 47/12
11,448,020 B2 * 9/2022 Plano ..... E21B 19/22
12,173,605 B1 12/2024 Gleitman et al.
12,188,351 B2 * 1/2025 Hawkinson ..... E21B 47/13
2003/0034177 A1 * 2/2003 Chitwood ..... E21B 4/04 175/104
2006/0048933 A1 * 3/2006 Van Way ..... E21B 19/22 166/77.2
2007/0158063 A1 * 7/2007 Van Way ..... E21B 19/22 166/77.2
2008/0265226 A1 * 10/2008 Richards ..... E21B 19/22 254/270
2011/0083900 A1 * 4/2011 Lavrut ..... E21B 4/18 175/57
2011/0133741 A1 * 6/2011 Clark ..... E21B 7/046 324/345
2012/0061143 A1 * 3/2012 Hay ..... E21B 47/13 340/854.3
2012/0139748 A1 * 6/2012 Hay ..... E21B 47/09 340/854.1
2012/0168177 A1 7/2012 Moeuy
2012/0267168 A1 * 10/2012 Grubb ..... B23K 26/0093 250/492.1
2014/0008968 A1 * 1/2014 Moeny ..... E21B 7/15 307/106
2014/0027110 A1 * 1/2014 Ageev ..... E21B 28/00 166/63
2014/0196953 A1 7/2014 Chitwood et al.
2016/0017663 A1 * 1/2016 Moeny ..... E21B 17/003 175/327
2016/0076339 A1 * 3/2016 Martin ..... E21B 47/017 166/57
2016/0265339 A1 * 9/2016 Xia ..... G02B 6/4411
2016/0273337 A1 * 9/2016 Donderici ..... G01V 3/26
2020/0115964 A1 * 4/2020 Nesgaard ..... H02G 11/02
2020/0340339 A1 * 10/2020 Saltykov ..... E21B 43/24
2021/0293127 A1 9/2021 Donderici et al.
2022/0003057 A1 * 1/2022 Plano ..... E21B 3/022
2023/0234331 A1 7/2023 Kukuchek et al.
2025/0034946 A1 * 1/2025 Pai ..... E21B 41/0085
2025/0075569 A1 * 3/2025 Pai ..... E21B 17/206
2025/0250863 A1 * 8/2025 Gleitman ..... E21B 7/00

FOREIGN PATENT DOCUMENTS

EP 4190556 A2 7/2023
SK 501282018 U1 * 8/2019 ..... F16L 11/22
WO WO-2010141004 A1 * 12/2010 ..... E21B 47/13
WO 2024231754 A1 11/2024
WO WO-2025088194 A1 * 5/2025 ..... E21B 44/02

* cited by examiner

COMPOSITE UMBILICAL FOR PULSE POWER BORING SYSTEM

BACKGROUND

Pulse power boring, hence forth called pulse power, is a method of earth excavation for wellbore formation. In particular, pulse power is advantageous for excavating very hard rock where normal drilling technologies using drill bits is not economical due to conventional drill bits wearing out in just a few short hours at thousands of feet below the earth's surface resulting in uneconomical bit replacements lasting several days each time when using drill pipe. Another common name for the method is called electro-crushing. The excavation occurs by imparting a high voltage electric pulse of current through the rock at the base of the wellbore. This current heats the fluid entrained in the rock and causes a rapid expansion which results in the rock exploding apart into small fragments which is then excavated from the well bore by a circulating fluid designed to carry this rock debris back to the surface. Another technique is to heat the fluid with a high energy electric pulse just above the rock in the circulating fluid to impart a localized momentary high pressure spike, which crushes the rock below and causing it to break apart. Again the debris is swept back to the surface by a circulating fluid. In some cases either method could be assisted with conventional bit cutters on concert with a downhole drive system below the tractor, which are rotated to aid in the excavation process. One of the main problems with pulse power may be how to transmit power down the drill string from surface. There may be difficulties in maintaining a reliable and safe connection to a conductive member in the drill pipe to propagate electrical power down to the pulse power unit. Furthermore, the insulated conductor in the drill pipe may further restrict the amount of mud flow verses pressure capability of the tool. The system and method of the present disclosure may address one or more of these issues.

BRIEF DESCRIPTION OF THE DRAWINGS

For a more complete understanding of the present disclosure, reference is now made to the following brief description, taken in connection with the accompanying drawings and detailed description, wherein like reference numerals represent like parts.

DETAILED DESCRIPTION

Figure 1A:
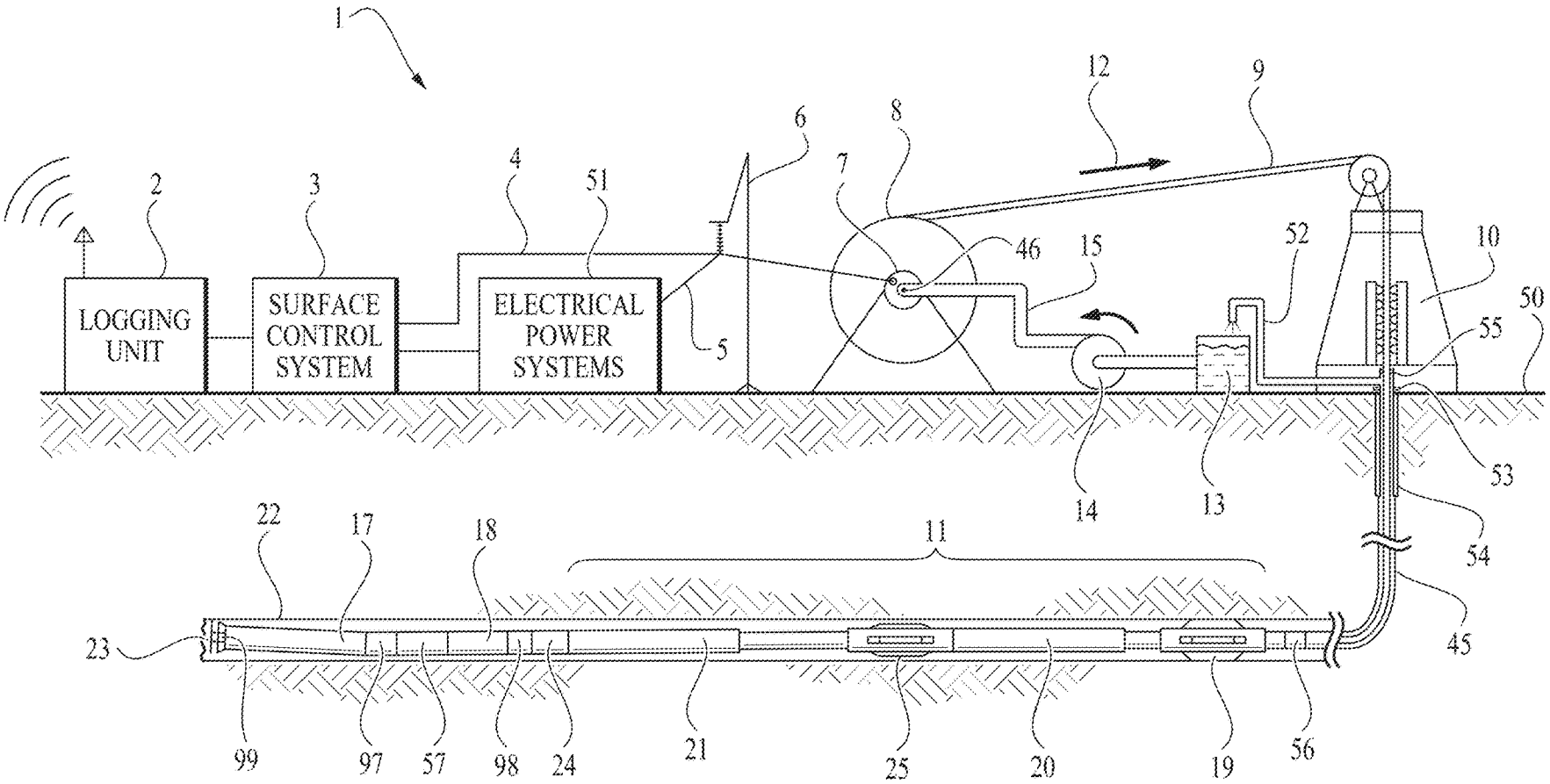
FIG. 1A is a schematic diagram of a pulse power umbilical drilling system, according to an embodiment of the present disclosure.

It should be understood at the outset that although illustrative implementations of one or more embodiments are illustrated below, the disclosed systems and methods may be implemented using any number of techniques, whether currently known or not yet in existence. The description that follows includes example systems, methods, techniques, and program flows that embody aspects of the disclosure. However, it is understood that this disclosure may be practiced without these specific details. For brevity, well-known steps, protocols, structures, and techniques have not been shown in detail in order not to obfuscate the description. The disclosure should in no way be limited to the illustrative implementations, drawings, and techniques illustrated below, but may be modified within the scope of the appended claims along with their full scope of equivalents.

In some embodiments, a composite drill string is provided with a tractor system to push or pull a bottom hole assembly (BHA) along a bore hole. The power cable may be embedded in a composite umbilical. This configuration may offer several advantages. For example, it may avoid long tripping with a convention drill string for very deep geothermal wells. The composite umbilicals can be at or close to neutrally buoyant in the drilling fluid for near endless depth capability as the drag force on the umbilical is greatly reduced compared to conventional drill pipe. The composite segments can be easily daisy-chained together to use multiple reels for very deep holes, which may be beneficial for geo-thermal applications as it would be difficult to transport to the wellbore location a reel that could span the entire depth required for the desired wellbore. The composite itself may lend itself to carry a plurality of conductors for communications and power to the downhole assembly from surface. The composite may be configured to support cooling channels which could carry a cryogenic cooling fluid or other kind of cooling fluid inside the conductor, such as a center pathway, or near the conductor or around the pulse power conductors.

The use of the composite coil tubing system that can be daisy-chained with multiple reels can speed up tripping dramatically and provide for almost endless depth of penetration for pulse power drilling systems using a neutral or near neutral composite buoyancy. Furthermore, the high voltage conductors may be safely embedded in the composite wall so that they may provide a robust insulated path for electric current or in an insulated cable in inside diameter of the composite tubing partically or completely immersed in the circulating fluid, to power bottom hole assembly (BHA) components such as communications systems, formation sensors, actuators, or boring parameter sensors, an optional downhole drive, such as an electric motor or positive displacement motor, below the tractor to impart rotation on at least a portion of the BHA, the downhole tractor and pulse power platform. For wells at depths of 3,000-5,000 m or more, this approach may be much faster than conventional drill strings, which may take days to do a round trip due to a failure in the BHA or reaching a desired total depth (TD) for a hole section. The optional, absence of a downhole drive may allow for taking full advantage of a composite coil tubing umbilical where torque capacity of the umbilical connection to the BHA may be a concern.

The pulse power drilling system may be employed for geothermal applications. Geothermal boring installations may be semi-permanent, for example, lasting for decades. Pulse power drilling systems may require very little weight to function correctly. Often, less than 100 lbs of force may be adequate to effect good formation contact on the bottom of the hole with the electrode, which is far below the thousands of pounds force needed for conventional drill bits. Another factor may be that there is often no need to rotate a pulse power drilling system, hence the limitations of torque carrying capability of an umbilical string and its connection to the BHA may be very low in comparison to drill pipe.

In some embodiments, a neutrally buoyant or near neutrally buoyant composite tubing string is used. This may be important because the neutral buoyancy may eliminate a great deal of drag force on the umbilical and can allow pulse power BHAs to drill enormous distances conveyed by a tractor system, that may not be possible with a conventional drill string. Because of the time needed to drill geothermal wells, a composite coil tubing handling system may be employed that allows for continuous boring by the pulse power system in conjunction with a downhole tractor system without the need to stop to attach a new coil as segments of coils can be pre-daisy chained together prior to the start of boring.

Referring to FIG. 1A, an exemplary pulse power umbilical drilling system 1 is shown. On the surface 50, there may be a logging unit 2 where an operator of the system 1 can be located. Alternatively, the operator and or parts of the control systems can be remote from the rig and send signals to the logging unit 2 through a remote communications system such as an internet connection over a STARLINK system or other form of communications channel such as a land line. The logging unit 2 may collect data and direct commands to the surface control system 3 to control the boring operation. The surface control system 3 may route commands over a communications line (e.g., a communication channel) that may be separate or integrated with the power cable 5. The communications line 4 can be one or more electrical conductors or a fiber optic communications line. The fiber optic communication cable may be advantageous in that it may not be affected by interferences from the power cable 5. The power cable 5 may carry power from the electric power systems 51 and may include a plurality of conductors for providing various power needs for the pulse power electrode 23, the tractor 11, and/or various downhole control and sensor systems. To further reduce electrical losses and keep the composite tubing from heating up, a plurality of parallel electrical wires to reduce the electric current density in anyone one cable may be embedded in the wall of a composite umbilical 9 and/or the surface control system 3 may control the electrical power system that is used to transmit electrical energy to the BHA 16 over the umbilical 9. The power cable 5 and/or the communications line 4 may be supported by a support pole 6. The power cable 5 and/or communications line 4 may be fed into a slip ring 7 on an umbilical reel 8 that may connect the power cable 5 and the communications line 4 to conductors in the wall of the umbilical 9 and/or electrical conductors inside the umbilical 9.

The composite umbilical 9 may be spooled on or off the reel 8 depending on the desired direction. A motor fitted to the reel can assist with winding up the reel when pulling out of the hole. The umbilical 9 may run from the reel 8 to a surface feeder 10 (e.g., withdrawal system or injector)). The umbilical 9 may be supported to facilitate its alignment into the surface feeder 10. The surface feeder 10 may help to maintain feed control in either direction by measuring the tension on the umbilical 9 and keeping umbilical longitudinal tension within certain limits for feeding or withdrawing the umbilical 9.

The umbilical 9 may extend down the wellbore 45 and may be connected to the BHA 16 where the power and communications may be plugged into the top of a tractor assembly 11 of the BHA 16. In various embodiments, the power and communications lines could be plugged into any other form of termination point on the top of the BHA 16 that has receptacles compatible to receive the umbilical connection. In some embodiments, there is a separate connector sub.

The tractor assembly 11 may be a continuous feed tractor (e.g., the borehole may always be allowed to advance regardless of whether the tractor 11 is holding the umbilical 9 stationary while it stretches out or is pulling the umbilical 9 deeper while at the same time pushing the pulse power system forward). Being able to always advance may not be possible with conventional drill pipe. The continuous boring system of the present disclosure may maximize the overall rate of penetration and minimize days to total depth (TD) for the pulse power drilling system 1.

In some embodiments, umbilical 9 does not rotate (e.g., because the BHA 16 does not rotate). The pulse power system 1 may support continuous surveys and/or ranging transmissions and/or ranging measurements without the need to stop boring operations to take a stationary survey or ranging measurement or ranging signal transmission. The BHA 16 can also be fitted with magnetic ranging transmitters and receivers. A wire can be used in the composite umbilical 9 for single wire ranging.

The drilling fluid 12 may be stored in a return tank 13. A return line 52 on surface may carry drilling fluid 12 from the wellbore 45 to the return tank 13. The return tank 13 may be fluidly coupled to a pump 14, which may pump the drilling fluid 12 to the reel 8 via a flow line 15 and then to a bore of the umbilical 9. The drilling fluid 12 may flow through the tractor assembly 11 and the BHA 16 and out the bottom of the electrode of the pulse power drilling system 17. The fluid 12 may then return to the surface 50 via the annulus between the borehole wall 22 and the outer wall of the umbilical 9. The drilling fluid 12 may then return to the return tank 13 after cuttings debris is removed. A blowout preventer (BOP) 53 may be mounted on top of a casing 54 of the wellbore 45. A wiper 55 may be configured to clean the inside of the casing.

The pulse power system 17 may be disposed in the portion of the BHA 16 (e.g., below the tractor 11). Other systems of the BHA 16 may be disposed in, below or on top of the tractor assembly 11. The BHA 16 may have an LWD/MWD logging system with borehole survey equipment which may utilize magnetometers, accelerometers and/or gyroscopes and/or magnetic ranging transmitter(s) and/or receiver(s). The logging system may gather data from logging sensors 57 of the BHA 16.

A downhole weight on electrode sensor 18 (e.g., an axial force sensor) may be used to monitor the force on the pulse power electrode 23. An electric motor driven or hydromechanical motor orientor 98 may be used for oriented steering or other steering apparatus and systems. A bent sub 97 may also be used for steering purposes in conjunction with an orientor to orient the bent sub in a desired toolface direction. The controller 3 may control this force with the use of the tractor assembly 11 to maintain an optimal axial force to a desired value. Additionally, there may be a proximity sensor 99 positioned in the pulse power electrode to measure the distance the electrode is from the bottom of the borehole. The controller 3 may use feedback control to optimize the rate of penetration and/or hole cleaning needs by applying necessary weight on the electrode to the bottom of the borehole or maintain the electrode a desired distance above the bottom of the borehole when in electro-crushing mode of boring to optimize the boring process. This control system 3 may be positioned at the surface 50. Alternatively, there may be a downhole control system configured to perform these functions, and the surface control system 3 may serve as a backup.

In concert with the weight on electrode sensor 18, there may be a pull force sensor 56 on the top of the tractor 11 above the upper anchor assembly 19 for monitoring the axial and torsional force on the umbilical to the top of the BHA 16. The pull force sensor 56 may be useful for making sure that when pulling the umbilical 9 along it does not pull so hard as to break the umbilical 9 with the tractor force. If high pull forces are detected, it could be an indication that the surface feed controller 10 is not paying out enough of the umbilical 9 to keep up with the tractor 11 pulling on the umbilical 9. For this reason, when the tractor 11 is pulling, the surface feed controller 10 can maintain enough force to hold the umbilical 9 stationary when the tractor 11 is not pulling but allow the umbilical 9 to slip above a certain holding threshold so that the umbilical 9 can pay out by the demand from the downhole tractor 11. If the umbilical 9 is neutrally buoyant, there may be low to zero holding force on the injector feeder 10, allowing the tractor 11 to pull the umbilical 9 without much or no resistance. It may depend on the situation and the buoyancy of the umbilical 9. The umbilical 9 may be pushed in at surface or it may float, or it may be held back on the pay out of the umbilical if negatively buoyant.

In some embodiments, a mud system is provided. The mud system may control the mud density to keep the umbilical neutrally buoyant. The controller 3 may control the mud system to keep the fluid density at an optimal value. This may be accomplished, for example, in the geothermal rock area at great depths where the hole is deep enough to be in low-porous and low permeable consolidated high compression strength formation, such as igneous, metamorphic or sedimentary formations where all that is needed is to monitor bore hole mechanical stability rather than watch for formation kick in general. As such, the buoyancy of the umbilical 9 can be configured with a desirable density for boring the formation deep down below the in or below sedimentary basins. More or less dense material may be added to the umbilical 9 to set its density in a desired range for geothermal boring depths that are in excess of 1000 m or more in vertical depth.

Figure 2A:
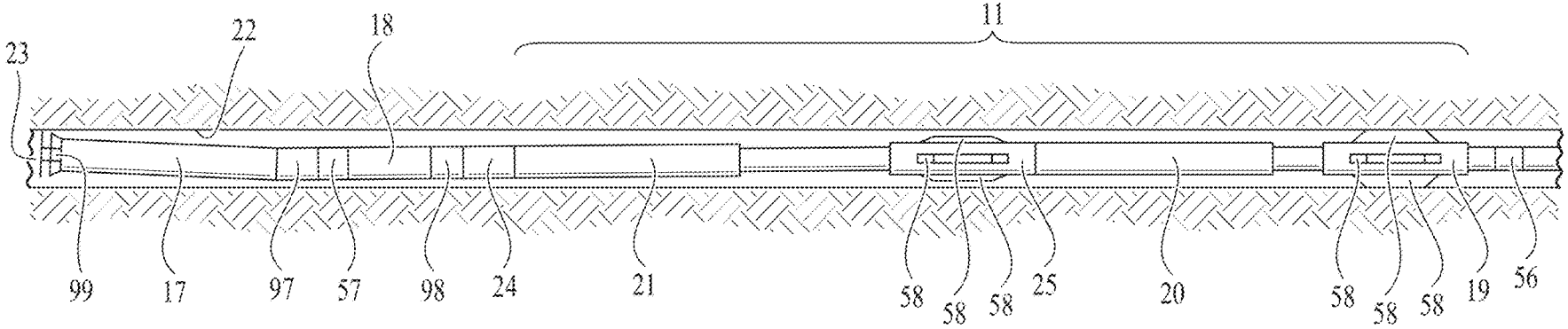
FIG. 2A is a schematic diagram of a bottom hole assembly, according to an embodiment.
Figure 2B:
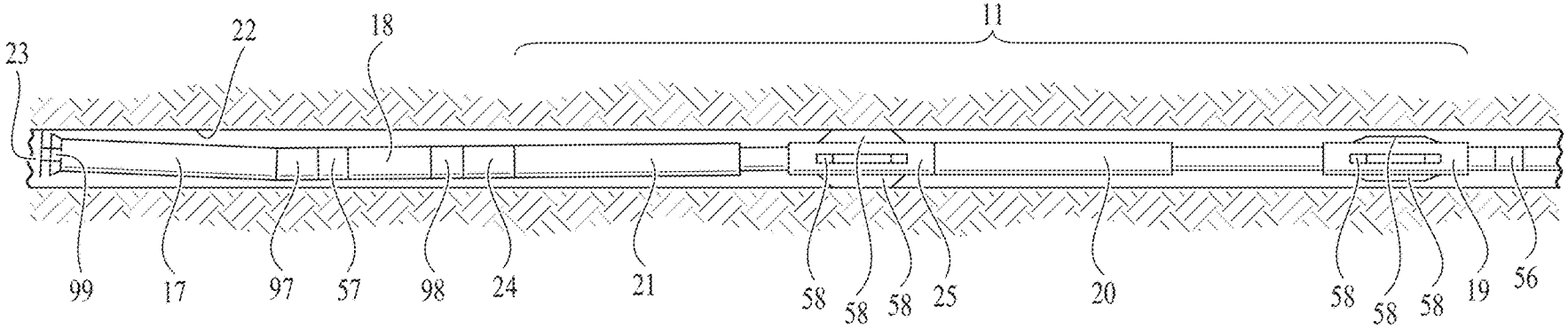
FIG. 2B is a schematic diagram of the bottom hole assembly in another position, according to the embodiment of FIG. 2A.

Referring to FIG. 2, the tractor 11 can operate in two different modes while allowing for continuous movement forward or backward of the pulse power electrode 23. The direction of the BHA 16 may be controlled by an upper anchor 19 and a lower anchor 25 which may engage the wall 22 of the wellbore 45 and a ram (e.g., the upper ram 20 or the lower ram 21) configured to expand or contract. By sequencing the movement of the ram 20,21, the upper anchor 19, and the lower anchor 25, the tractor 11 can move and push or pull the BHA 16 along with it.

The tractor system 11 may push the BHA 16 deeper into the borehole wall 22 as the pulse power system 17 bores a hole by maintaining a desired axial force on the pulse power electrode 23. As a starting point, the pads 58 on the upper anchor 19 may be pushed out to engage the bore hole wall 22, anchoring this portion of the BHA 16 in the wellbore 45. This actuation may be performed hydraulically or by any suitable motive means of force. The anchors 19,25 may be held in place so long as there is hydraulic pressure. If the pressure is relieved, the anchor force may be disengaged from the bore hole wall 22 as a radial force but the pads 58 may still be partially or somewhat extended. In some embodiments, a mechanism is provided to retract the pads 58. A bi-directional hydraulic ram inside the anchor 19,25 may be to be used to push out or pull back the anchor pads 58. When tripping, it may be desirable to retract these pads 58 to be at least disengaged from the borehole wall 22 allowing the surface feeder and reel or carousel to pull the umbilical back up the hole.

The surface control system 3 and/or a downhole controller 24 may control the upper anchor 19. The controller 24 may apply hydraulic power to the upper ram 20, causing a piston to move out of a cylinder and push the BHA 16 deeper into the hole while monitoring the weight on electrode force to keep it at an optimal value. Meanwhile, the lower anchor 25 may have been disengaged by the controller 24 and the lower ram 21 may be either allowed to squeeze the piston back into the cylinder or the piston may be actively pumped back into the cylinder but not at a speed that would cause the force of the pulse power electrode 23 to drop below a desired value range. The rams 20,21 may work together to maintain the force on the pulse power electrode 23 at a desired value or an off bottom desired distance. In some embodiments, the contraction of the lower ram 21 is metered such that as it applies a minimum amount of resistance to maintain a desired axial force on the pulse power electrode 23.

When the upper ram 20 has expanded to a desired travel length, the lower ram 21 may then do the pushing. The upper anchor 19 may be disengaged and the lower anchor 25 may be engaged. The lower ram 21 may begin to expand, maintaining a desired amount of axial force on the pulse power electrode 23. In the meantime, the upper ram 20 may begin to contract, which may cause the umbilical to be pulled deeper into the wellbore 45 as the upper ram 20 shortens in length. A pull force sensor 56 may be monitored by the downhole controller 24 to ensure that the pull force on the umbilical 9 does not exceed a desired threshold. In concert, the downhole controller 24 may send requests to adjust pay out of the umbilical 9 through the feeder 10 to help maintain the desired pay out force on the umbilical string 9. These commands may be sent over the communications channel to the surface control system 3.

Any functions of the downhole controller 24 may be controlled completely on surface (e.g., by the surface control system 3), and vice versa. In some embodiments, the downhole controller 24 may be omitted. However, having the downhole controller 24 perform at least some of the control functions may reduce the amount of wires needed in the umbilical.

Once the lower ram 21 has expanded to a desired length, the lower anchor 25 may disengage and the upper anchor 19 may re-engage, and the process may repeat, which may result in a continuous or near continuous boring operation.

Figure 4:
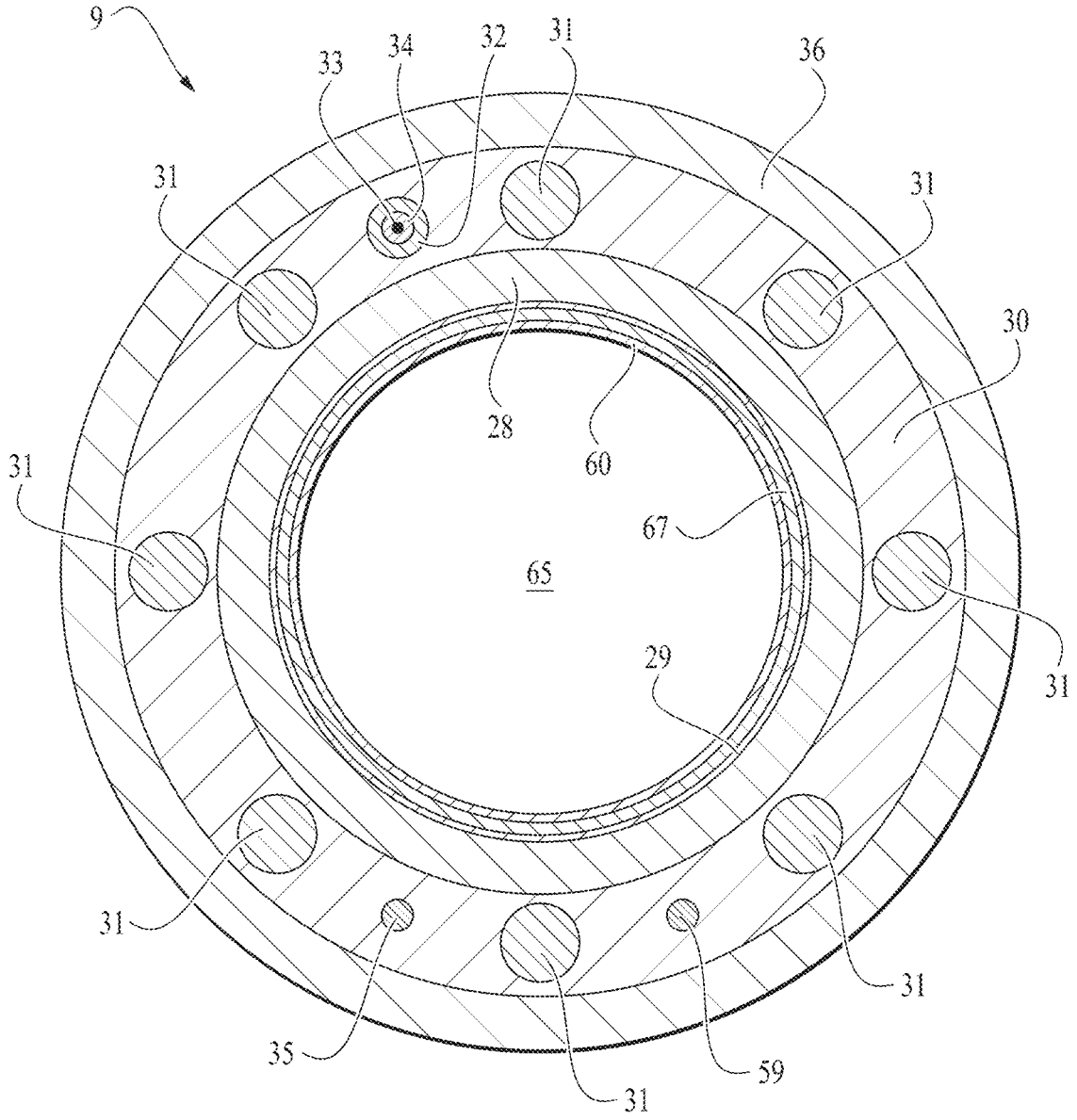
FIG. 4 is a cross sectional top view of an umbilical, according to an embodiment.

Referring to FIG. 4, a cross sectional view of an exemplary composite umbilical 9 is shown. The composite umbilical 9 may comprise power cables 31 and one or more communication cables having 1 or more electrical conductors and generally at least two electrically insulated conductors in the cable 32,59. If drilling fluid flow driven downhole power generator is used, then the umbilical 9 does not necessarily have to carry power down hole to the BHA 16 (see FIG. 1). It could still be equipped with power cables 31 even if not immediately needed, e.g., to be used as a backup in the event of a generator failure downhole. In some embodiments, some of the power can be generated downhole in the BHA 16, and some of it can be transmitted over the umbilical 9. These power sources can complement each other in the event that there is not enough space available for a large-diameter generator compared to the borehole diameter. For example, the downhole generator may produce 50% of the needed power and another 50% of the needed power may be transmitted from surface. This hybrid approach may provide the benefit of reducing the resistive loses over the umbilical 9 if not enough power carrying capacity is available in the umbilical 9 alone.

Figure 3:
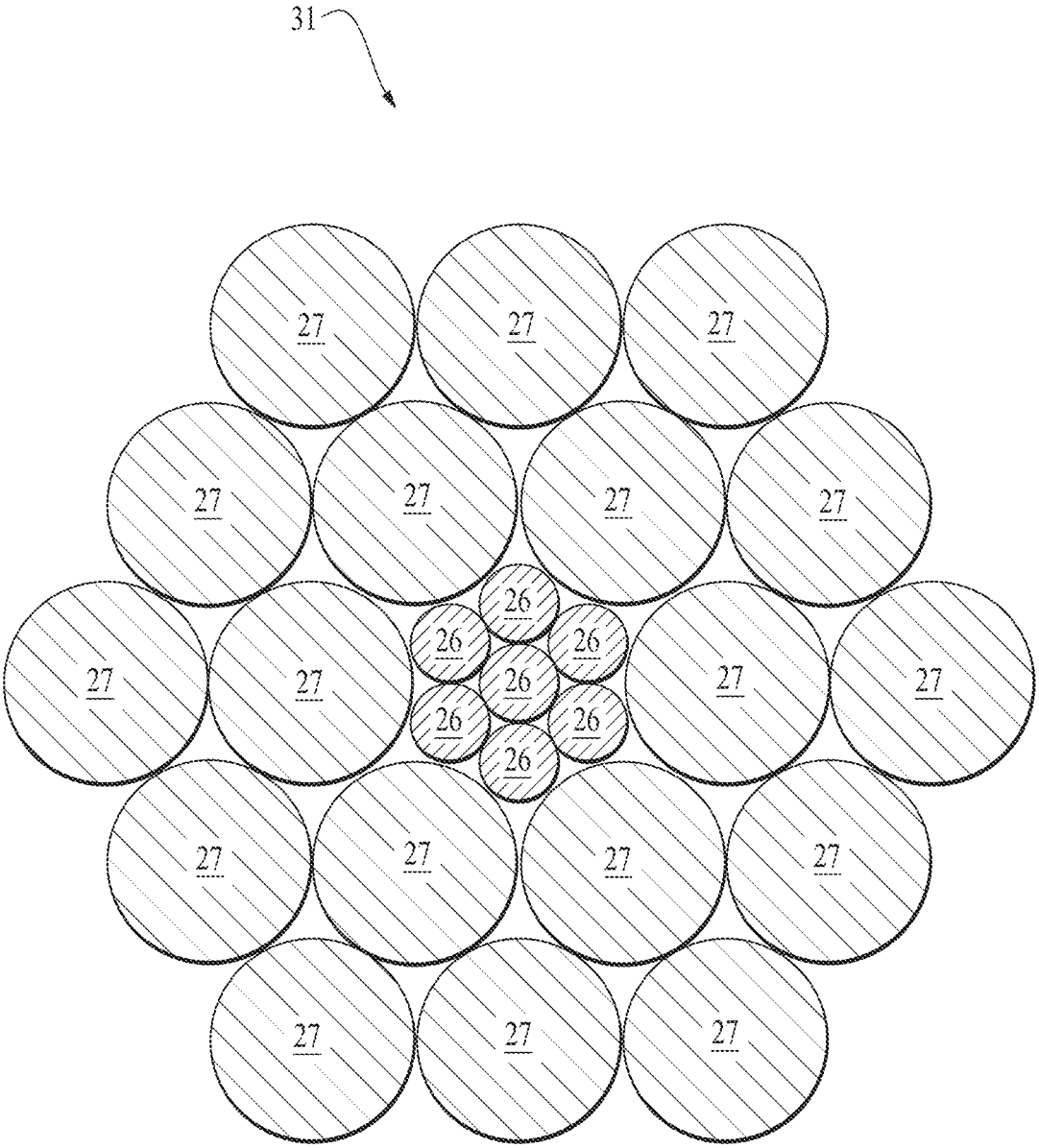
FIG. 3 is a cross sectional top view of a power cable, according to an embodiment.

The cables 31,32,59 may be disposed inside a cable carrier layer 30. The power cables 31 may be stranded aluminum, silver or copper wire. In some embodiments, the power cables 31 are made of a steel stranded core with aluminum strands around it. Aluminum presents the advantages of being lighter, which may add to the neutral buoyancy. Aluminum is also a good electrical conductor. In some embodiments, the power cables 31 have a stranded wire steel core for more tensile strength. The power cables 31 may spiral in a helix fashion along the length of the umbilical 9 to offer better strength to the umbilical 9. FIG. 3 shows an exemplary power cable 31 having a stranded steel core 26 with aluminum strands 27 around it. The air may be removed from the spaces between the strands 27. The cables may be treated with a high temperature resin under pressure to fill the cavities with the resin, or another means may be used to remove the air entrained between the strands. The reason for replacing the air with a non-compressible medium such as hardened resin may be to prevent hydrostatic pressures (e.g., in excess of 30 ksi or more) from deforming the umbilical 9.

The cable carrier layer 30 could be made of, for example, PEEK or PTFE, depending on the flexibility needs. PEEK may be advantageous for strength but may be more rigid than needed for spooling onto reels or carousels. The cable carrier layer 30 may be injection molded onto the cables 32,31,59. An erosion resistant layer 29 may be formed on the inner wrap 28. The erosion resistant layer 29 may be abrasive. The erosion resistant layer 29 may be a thin steel wall or other erosion resistant material (e.g., a material such as tungsten carbide, e.g., as a coating formed by an additive manufacturing method). The erosion resistant layer 29 can be sacrificial. As it wears out, flowing fluid may encounter the tungsten carbide or other hard coating that stops further erosion. If thin enough, it can offer flexibility for the umbilical while still offering some erosion protection. A thin metal wall tubing liner 67 could be utilized. The material may be ductile yet have a high hardness. The material could also be a wound coil similar to a spring material offering flexibility but still abrasion resistance. The function may be to act as a carrier for the additive manufacturing of the erosion coating. Other methods of spiraling a strip overlapping or crisscrossing the in a braided fashion on the coated liner 67 could aid in providing flexibility. The liner 67 could be disposed between the hydrophobic coating 60 and the erosion resistant material 29. A hydrophobic coating 60 may be added (e.g., on the erosion resistant material 29) to reduce fluid flow friction and thereby reduce circulating pressure of the drilling fluid. The hydrophobic coating 60 can be sprayed on at desired intervals to refresh the umbilical 9.

Another exemplary method is to utilize ceramic impregnation of the composite where the hardness of the ceramic can be boosted by adding in ceramic particles into the carbon fiber matrix. The ceramic impregnation technique may provide the additional benefit of abrasion protection. The inner composite wrap 28 could be made of this material. The flow velocity and sand content of the drilling fluid may be optimized to be as low as possible to lengthen the life of the umbilical string.

The inner composite wrap 28 may be, for example, a carbon fiber composite. It may be light weight and have tremendous radial strength. The inner composite wrap 28 may carry a big portion of the radial pressure force of the drilling fluid thus providing for a high burst pressure to support higher circulating pressures needed for long wellbore intervals.

The cable carrier layer 30 may be made of an injectable formed material around the cables 31,32,59. The cable carrier layer 30 may be injected on the outer surface of the inner composite wrap 28 to remove all air in this area. The material of the cable carrier layer 30 may have a similar coefficient of expansion rate as its surrounding material to minimize hoop stresses. Alternately, it may have a lower coefficient of expansion so that it will re-enforce the inner wrap as it attempts to expand radially by squeezing inward on the outwardly expanding inner wrap 28. The umbilical 9 may have to contend with the expansion force of the drilling fluid pressure inside if the umbilical 9 is neutrally buoyant.

The cable carrier layer 30 can be made of, for example, PTFE (Teflon), PEEK (polyether ether ketone), or similar plastic which can withstand up to at least 260° C. and has good flexural and tensile properties. The Young's modulus of the cable carrier layer 30 may be as close as possible to the inner wrap 28 to reduce interstitial shear forces of the between the inner wrap 28 and the cable carrier layer 30. The cable carrier layer 30 may be made of a strong, flexible material that can be continuous-injection mold formed around the cables 31,32,59 and/or the inner wrap 28. The non-conductive cable carrier layer 30 may be used as an electrical insulator for the electric cables, which may result in more room for metal rather than an insulative cover over the cables 31,32,59.

The power cables 31 may be disposed in the cable carrier layer 30. The use of multiple power cables 31 (e.g., 2, 3, 4, 5, 6, 7, 8, 9, 10, 12, or more), may increase the overall current carrying capacity of the umbilical 9. At least two power cables 31 may be used for supplying electrical power to the BHA. In the embodiments in which there are a total of eight cables, four cables could be used for one polarity and the other four could be used for the opposite polarity for the power transfer. In general, half of the power cables 31 may be used for one polarity and the other half of the power cables 31 may be used for the opposite polarity. DC power may be used to avoid eddy current losses (inductance) created in a surrounding electrically conductive drilling fluid, wellbore completion tubulars, generally in the upper regions of the wellbore and earth formations. The power cables 31 may alternate with respect to each other in polarity to reduce inductive losses. This may be especially helpful if there are variations in the current flow due to variable loading downhole under different modes of operation for the BHA. In the embodiments in which AC voltage is employed, downhole power converters may step up or down the voltage for various needs in the BHA. If AC power is to be used, it may be three-phase power using three, six or nine, or more multiples of 3, power cables, for example. The three-phase power may provide constant power to the BHA at any point in time and the voltages can be adjusted with a step up or step-down transformers in the BHA.

In addition to the power cables 31, a coaxial communication cable 32 may be disposed in the cable carrier layer 30. Using the coaxial communication cable 32 with a center conductor 33 and an outer cylindrical conductor 34 may help reduce signal losses and interference dramatically over the length of the cable at higher data rate frequencies. If desired, transmission over several miles may be achieved at high data rates typically in the megahertz range and possibly higher with this approach. In some embodiments, the coaxial communication cable 32 is a fiber optic communication cable. Using a fiber optic cable may prevent inductive common mode interference caused by currents in the power cables or the ranging cable and can offer much higher bandwidth. The communications can be accomplished over any two polarity power cables or any two cables where a load can be placed across it for detecting and transmitting communications. Parallel backup cables for coms can also be built into the cable carrier so if one communications cable becomes faulty or damaged, the backup cable can be used for coms. Redundant coms lines may be beneficial so as not to have to scrap the umbilical due to a failed coms line.

A single wire ranging cable 35 may also be disposed in the carrier cable 30. This may be a single wire conductor that is used to emit electromagnetic or magnetic ranging signals along the length of the umbilical 9 to aid following BHAs in adjacent bore holes to determine the distance and direction to the umbilical transmitting, aiding the following BHA to track beside a BHA that is deeper than the following BHA. The umbilical 9 may be used for single wire ranging methods.

An outer composite wrap 36 may be applied to the cable carrier layer 30. The outer wrap 36 could be made of the ceramic impregnated composite (e.g., the same as the inner composite wrap 28) to aid in abrasion wear resistance. Alternatively, an abrasive resistant layer could be coated on the outer composite wrap 36 (e.g., the same material as the erosion resistant layer 29).

Figure 5:
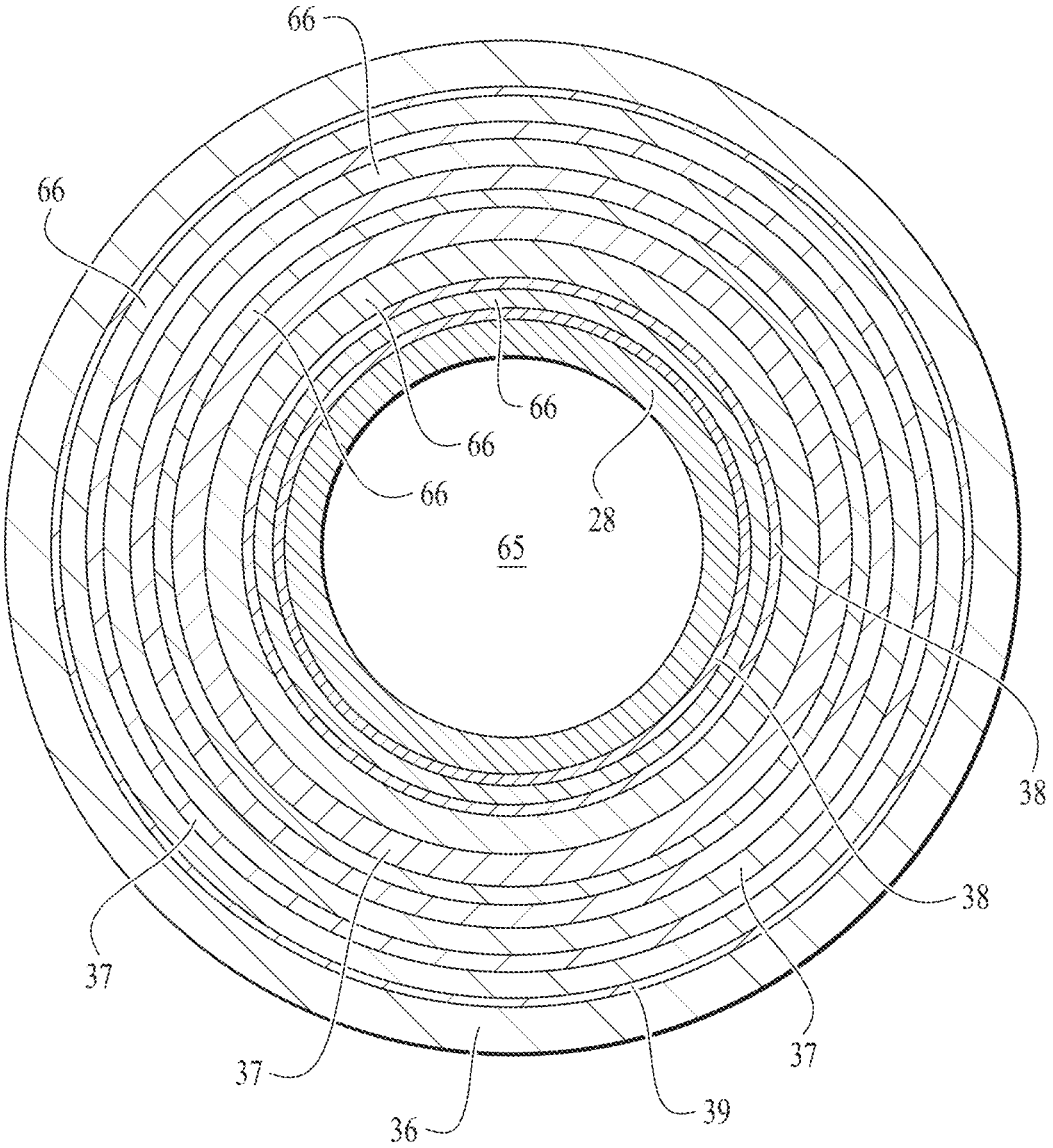
FIG. 5 is a cross sectional top view of an umbilical, according to another embodiment.

Referring to FIG. 5, another embodiment of the umbilical 9 is shown which has coaxial cables. In some embodiments, successive circular cross sections of woven conductor mesh are separated layer on layer by a dielectric insulator 66, which may be a composite wrap. This may present the advantage of easy circular connections between segments of umbilical strings that need to be connected together.

In some embodiments, there are at least three power cables 37 (e.g., for three-phase power). To balance the current capacity of each power cable 37, the smaller diameter cables 37 may be thicker (e.g., each conductor may have equal cross-sectional area regardless of diameter). The umbilical 9 may also have communication cables 38 and/or a ranging cable 39, which may also be coaxial. This configuration may be advantageous because it may facilitate connecting umbilical strings together and minimize construction cost. In another embodiment at least two power cables are used to transmit AC or DC power over the umbilical. In yet another embodiment at least two power cables can also be used as a communications channel for transmitting electrical signals and data in either direction.

Figure 6A:
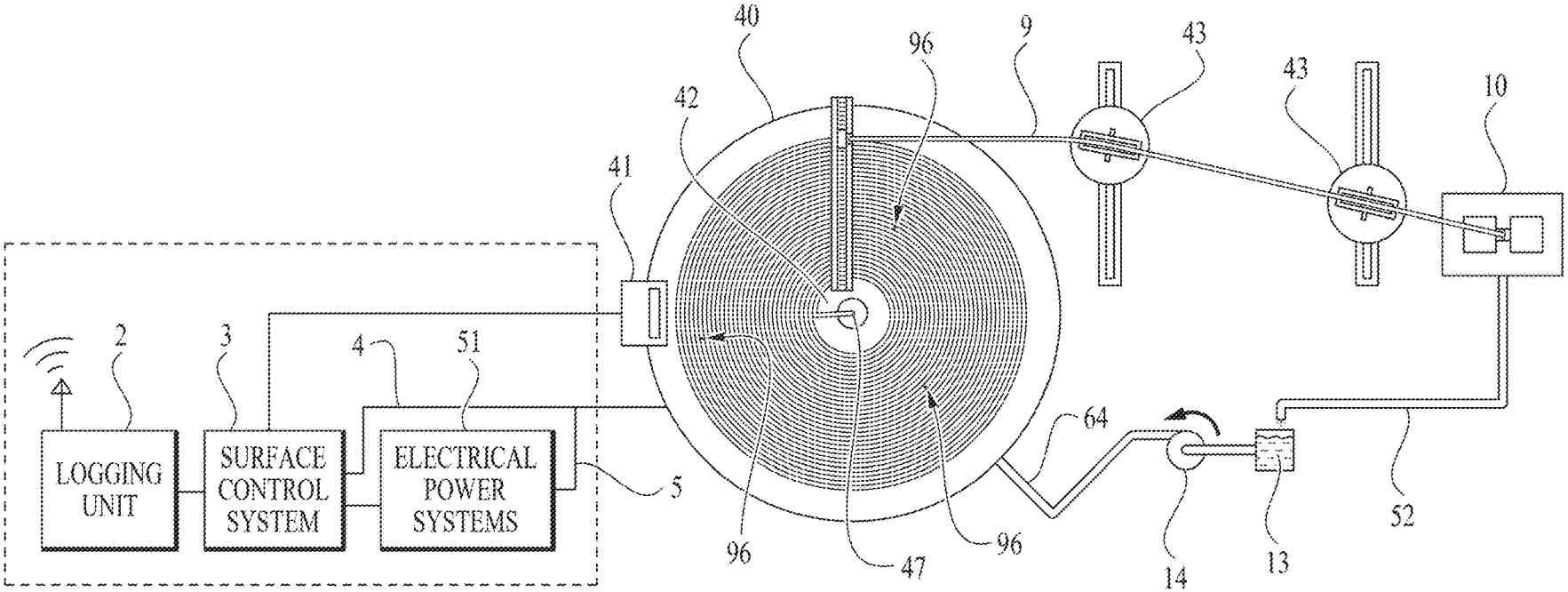
FIG. 6A is a schematic diagram of an umbilical feed system, according to an embodiment.
Figure 6B:
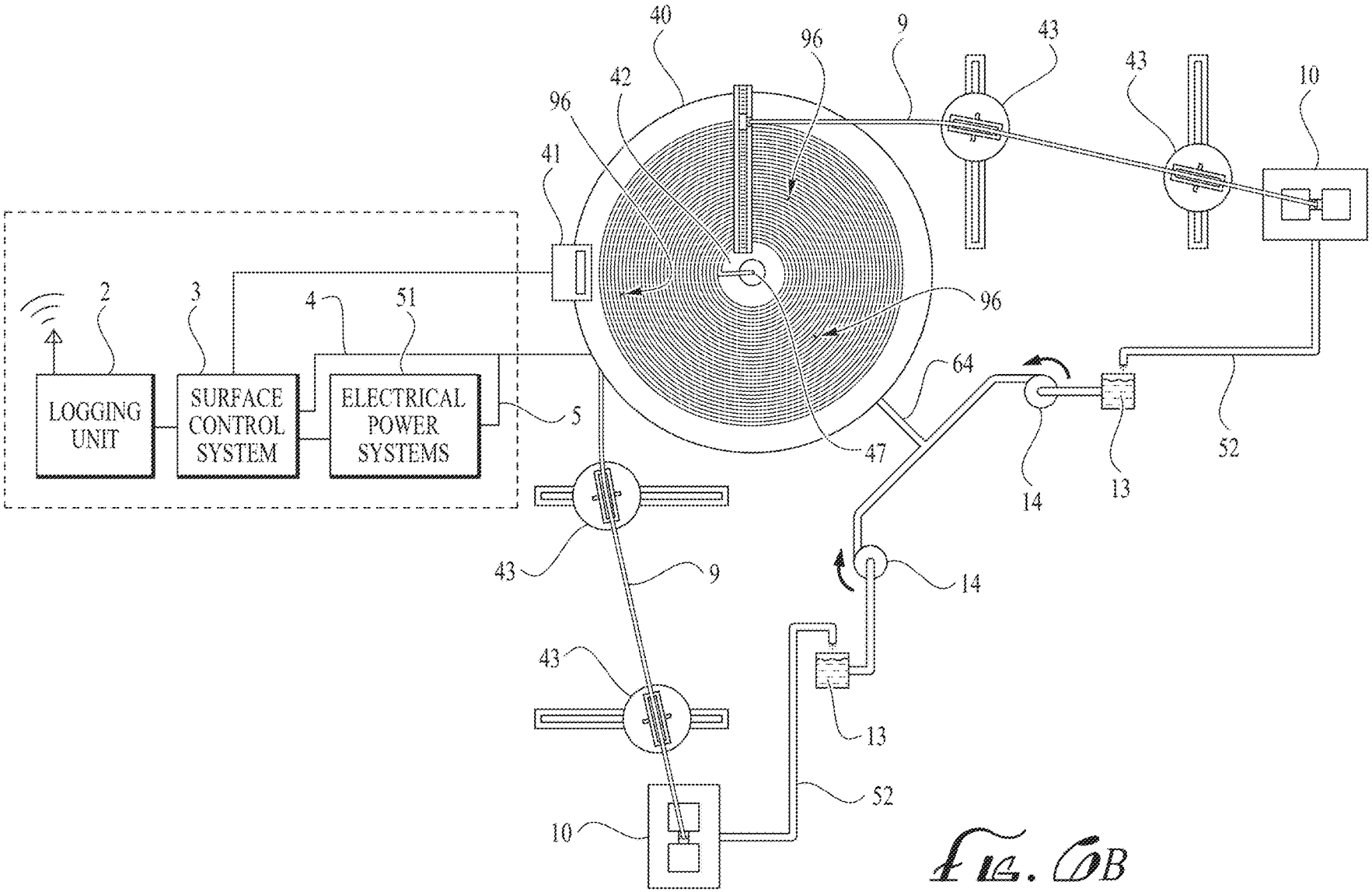
FIG. 6B is a schematic diagram of an umbilical feed system, according to another embodiment.

Referring to FIG. 6, an exemplary carousel umbilical carrier 40 is shown. The carousel carrier 40 may hold all the umbilical string segments that may be transported to location on individual reels. As an example, for bore holes in excess of 10,000 m, using a 200 m umbilical reels with such a configuration may be efficient because it may avoid frequent reel changes. For example, a piece-wise horizontal carousel 40 may be constructed at the rig site that can then be loaded with a plurality of umbilical strings, all connected end-to-end by segment connections 96 to make one surface reel at the rig site, in advance of the well boring operation. The carousel 40 may be made up of arc length segments, for example. Other components can easily be trucked from drilling location to drilling location to be assembled, then the umbilical reels may be spooled on from the individual reels. The horizontal carousel 40 may be advantageous due to the great depths of the bore holes (e.g., the horizontal carousel 40 may be able to accommodate a large volume of umbilical). In another embodiment, the carousel can be configured as a horizontal reel where the umbilical is loaded from the side rather than the top as would a normal real that carries smaller segments of umbilical shown in FIG. 1 (see element 8).

In this manner, the whole length of the umbilical 9 for the drilling job may be already created and may be tested, then made ready to be used for boring the entire job at once. While only one layer is shown in FIG. 6, the winding guide can stack several layers of the umbilical in the disk tray, one on top of the other, thus multiplying the carrying capacity of each umbilical container. The start of the umbilical 9 may then be connected to the drilling fluid pumps, power cables, communication cables, and/or ranging transmitter line(s). The carousel 40 may have a bearing support structure to allow one or more motors 41 to drive the carousel 40 (or the trays of the carousel 40) clockwise or counter clockwise. The carousel 40 may also be fitted with a brake to lock the carousel 40 in a position if needed. There may be a swivel 42 in the center. The swivel 42 may comprise a fluid swivel to allow drilling fluid to feed into the umbilical while it is rotating. The swivel 42 may comprise slip rings for power, communications. The swivel 42 may comprise magnetic ranging transmission connection(s) to the umbilical cable system from the surface systems.

One or more umbilical guides 43 may help to align the umbilical 9 so that it spools properly in the carousel tray. The surface feeder 10 may control the feed rate of the umbilical 9 in and out of the bore hole. In some embodiments, this configuration may present the advantage in that it is not necessary to move all the umbilical 9 between wells on a geothermal pad. Generally, enough umbilical 9 can be loaded onto the carousel 40 to reach several locations around the pad to be used for boring all the wells on the pad. In order to save footprint space, the horizontal carousels 40 (or trays of the carousels 40) can be stacked on top of each other to bore other holes on location. In some embodiments, stacked carousel trays can be independently rotated and fed with the umbilicals 9 and drilling fluid hook ups. There may be multiple advantages to this configuration. If one umbilical 9 requires servicing or replacement, another umbilical 9 on another tray can resume dispensing while the other umbilical 9 is being serviced. For example, if two holes are being bored at the same time, a third umbilical 9 can be made ready to immediately trip in the hole after another umbilical 9 is removed, which may avoid lengthy servicing delays.

The umbilical 9 on the carousel 40 may be made up of a plurality of umbilicals, connected end-to-end. The entire length of umbilical 9 needed for the hole to be bored may be available on the one carousel 40. Another advantage of the plate/tray stacking of carousels 40 may be that if one carousel 40 is not big enough to accommodate the entire length of umbilical that is required, one or more additional carousels (or carousel trays, e.g., stacked on each other) can contain the additional length needed to complete the job. A strategically located carousel 40 on a drilling lease location can aid in transferring the umbilical 9 more easily from well head to well head without the need to move the carousel 40.

Figure 7:
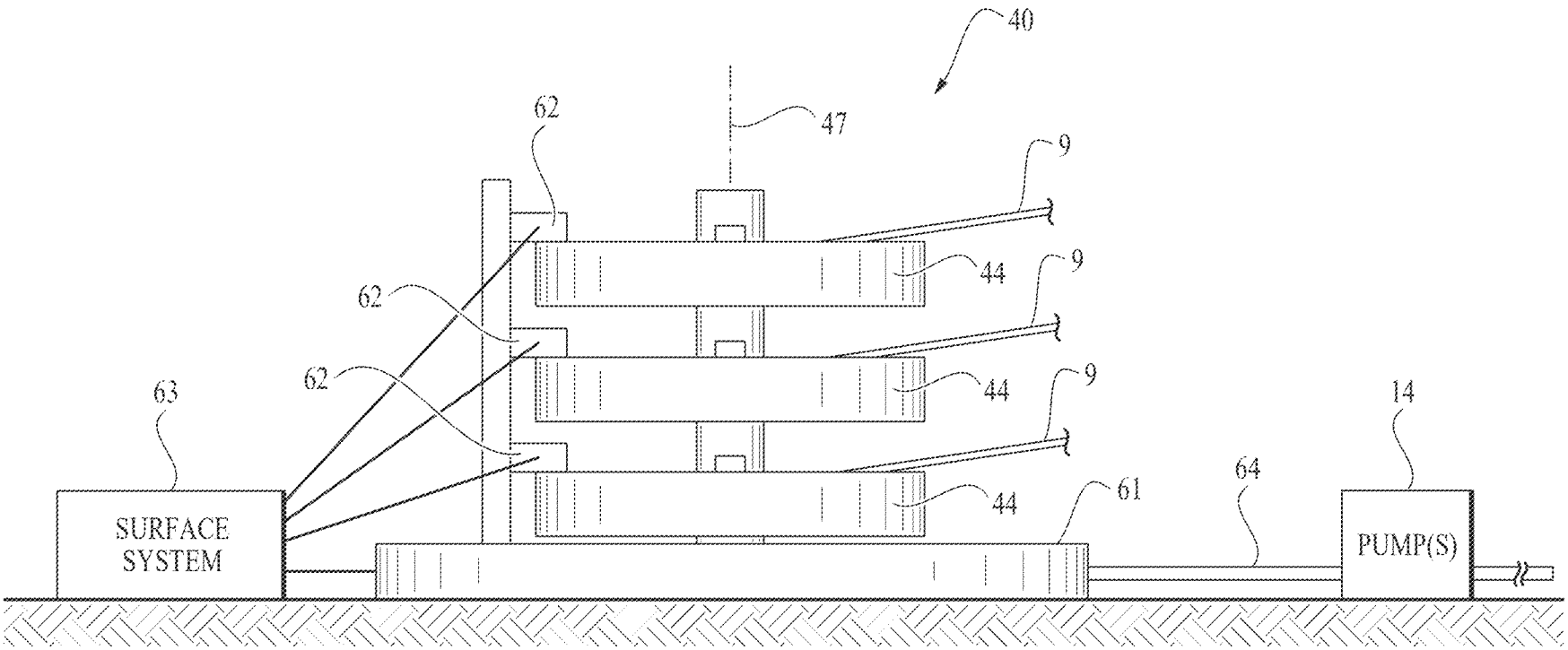
FIG. 7 is a side view of a carousel, according to an embodiment.

Referring to FIG. 7, the carousel 40 according to an embodiment is shown in more detail. The carousel 40 may include rotatable trays 44 of umbilical strings 9. The trays 44 may be plates, spools, reels, containers, or any other type of suitable structure. For geothermal drilling, two of the trays 44 may dispense umbilical 9 (e.g., simultaneously) and one of the trays 44 may serve as backup. Each carousel 40 may be driven independently by a motor 62. Each carousel 40 may also be equipped with a brake.

In some embodiments, a distribution manifold is installed in the carousel base 61 where drilling fluid of a common type and density may be fed to all trays 44 as the need for boring fluid exists. Fluid may be pumped from by drilling fluid pump 14 through a master flow line 64 to the carousel base 61. A surface system 63 may be coupled to the motors 62 and the carousel base 61. The surface system may include a system controller that controls the reeling or payout of umbilical as demanded by the downhole tractor for each wellbore. The surface system also controls the surface feeder 10 that controls the amount of umbilical being feed or pulled from the well bore. In this manner the amount of umbilical that is between the carousel and the feeder can be controlled so as to maintain umbilical tension at a desired value to prevent the umbilical from being too loose or too tight for the surface systems. Sensors are placed on the feeder 10 and the carousel to measure the axial tension on the umbilical between the feeder and the carousel to aid the controller in maintaining a desired umbilical tension during paying out or pulling up the umbilical. Further the controller receives movement can receive movement demands by the tractor to pull more umbilical in or out of the hole to facilitate boring or backward movement of the BHA. In this manner the controller can calculate rate at which the umbilical needs to be paid out by the carousel and feed by the feeder to service the needs of the tractor and boring operation downhole.

The pull force sensor 56 on the top of the tractor monitors the pull force and torque applied to the umbilical which is feed to the controller to aid the controller to calculate the necessary payout and feed of the umbilical to maintain this axial force below a desired threshold. Likewise for backward motion of the tractor up the hole the axial sensor can help the controller determine the rate and amount of umbilical that needs to be pulled out of the hole. The controller will control each individual carousel, feeder and downhole tractor independently from each other for managing payout and reeling in. The controller can control the volume flow by the drilling fluid pumps into the umbilical(s) to maintain a pressure and flow rate that is desired. Further the controller can control valves on a manifold that can direct a desired amount of boring fluid to any of the umbilicals in the umbilical stack. In another embodiment, each umbilical will have its own dedicated pump which is controlled by the controller to feed drilling fluid to its assigned umbilical. At great depths, there may be no porosity in the rock, so a drilling fluid may be used that is primarily suited for pulse power boring along with aiding in hole stability and excavated rock removal common to each bore hole. Alternatively, separate controllers, sensors, tanks and pumps for each bore hole may be provided including a downhole controller for controlling the tractor functions such as advancing the well bore as needed.

The control system may also control an electric motor drive system below the tractor. This electric motor may include a brake or locking mechanism where the motor may be engaged and the brake released to orient the electrode in a desired steering direction to steer the excavation in a desired direction. The controller would at least a portion of the BHA including the electrode to orient the electrode that at a desired angle or toolface relative to the borehole. Generally a toolface can be implemented by including a bent sub or tilting mechanism that tilts the electrode away from the longitudinal access of the borehole, thereby urging a direction change in the boring operation as a result of this angular difference. Once a desired orientation is in position the motor can stop and a brake engaged to hold the toolface in the desired orientation. Other steering mechanisms could also be used such as radial push pads above the electrode to urge the boring in a desired direction or other steering mechanisms to aid in boring the wellbore in a desired direction.

In some embodiments, the pulse power system 1 is installed on the sea floor. For example, the carousel, control system, umbilical 9, feeder and other elements needed to operate the pulse power system could be installed on the sea floor to service a a work area for borehole work overs or other intervention operations. As well, hole boring could occur from the sea floor system as well with pulse power drilling or other forms of rock destruction such as microwave energy using the umbilical 9 as a wave guide for a cyclotron. In some embodiments, the inner surface of the umbilical 9 is conductive to support the electromagnetic radiation propagation. An electromagnetic wave carrier material may fill the void in the umbilical 9. For example, the material may be able to withstand the pressure and offer low propagation loss of the EM radiation. In yet another embodiment, laser energy can be propagated through optical cables built into the wall of the umbilical similar to the power cables 31 described earlier or inside the umbilical in the cable carrier layer 30 to facilitate laser heating and destruction of the rock on the bottom of the borehole to excavate the bore hole.

Referring to FIGS. 1-7, a system 1 for well formation may include a first composite umbilical 9; a winding system (e.g., an umbilical reel 8 or a carousel 40) configured to hold and dispense the first composite umbilical 9; a first surface feeder 10 configured to feed the first composite umbilical 9 from the winding system into a first wellbore 45; and a first bottom hole assembly 16 coupled to the first composite umbilical 9 and configured to receive electric power and a first communication signal via the first composite umbilical 9. The first bottom hole assembly 16 may include a first tractor 11 and a first pulse power electrode 23 coupled to the first tractor 11. The pulse power electrode 23 may be part of a pulse power drilling system 17 disposed at an end of the tractor 11. In various embodiments, the pulse power electrode 23 may be replaced with any type of non-rotating tool. In some embodiments, the winding system comprises a reel 8. In some embodiments, an axis of rotation 46 of the reel is horizontally oriented with respect to gravity. In some embodiments, the winding system comprises a carousel 40, and an axis 47 of rotation of the carousel 40 is vertically oriented with respect to gravity.

The composite umbilical 9 may include an inner wrap 28; an outer wrap 36 disposed concentrically around the inner wrap 28; a cable carrier layer 30 disposed between the inner wrap 28 and the outer wrap 36; power cables 31 disposed in the cable carrier layer 30 and configured to carry the electric power; and/or a communication cable 32 disposed inside the cable carrier layer 30 and configured to carry the first communication signal. The power cables 31 may be evenly distributed in the cable carrier layer, e.g., the power cables 31 may be spaced apart by a constant interval. The power cables 31 may be configured to carry current in alternating polarities. An erosion resistant material 29 may be formed on the inner wrap 28 and/or the outer wrap 36. A hydrophobic coating 60 may be formed on the erosion resistant material 29. In some embodiments, the communication cable 32 is a coaxial cable 32. In some embodiments, the communication cable 32 is a fiber optic communication cable 59. In some embodiments, a wire ranging line 35 is disposed in the cable carrier 30. In some embodiments, the umbilical 9 comprises a bore 65 (e.g., a center hole) configured to direct drilling fluid downhole.

Referring to FIG. 5, in some embodiments, the first composite umbilical 9 comprises a coaxial configuration. The first composite umbilical 9 may include an inner wrap 28; an outer wrap 36 disposed concentrically around the inner wrap 28; power cables 37 coaxial with the inner wrap 28, disposed between the inner wrap 28 and the outer wrap 36, and configured to carry the electric power; and a communication cable 38 coaxial with the inner wrap 28, disposed between the inner wrap 28 and the outer wrap 36, and configured to carry the first communication signal. The power cables 31 may be configured to carry current in alternating current or direct current power. An erosion resistant material 29 may be formed on the inner wrap 28 and/or the outer wrap 36. A fluid friction reduction coating such as a hydrophobic coating 60 may be formed on the erosion resistant material 29 to reduce fluid friction of flowing boring fluid on the inner surface of the umbilical and thereby reduce the needed circulating pressure of the boring operation. Further the outer diameter of the umbilical could also be coated with a low fluid friction coating that would also aid in the reduction of circulating pressure for a given flow rate. In some embodiments, the communication cable 32 is a coaxial cable 32. In some embodiments, the communication cable 32 is a fiber optic communication cable 59. In some embodiments, a wire ranging line 35 is disposed in the cable carrier 30. In some embodiments, the umbilical 9 comprises a bore 65 (e.g., a center hole) configured to direct drilling fluid downhole. In some embodiments the ranging cable terminates electrically downhole onto the bottom hole assembly as a direct short, allowing for current to flow from the cable into the surrounding formation and then back to a surface electrode ground rod when voltage between the downhole BHA and the surface ground rod electrode is applied.

Figure 1B:
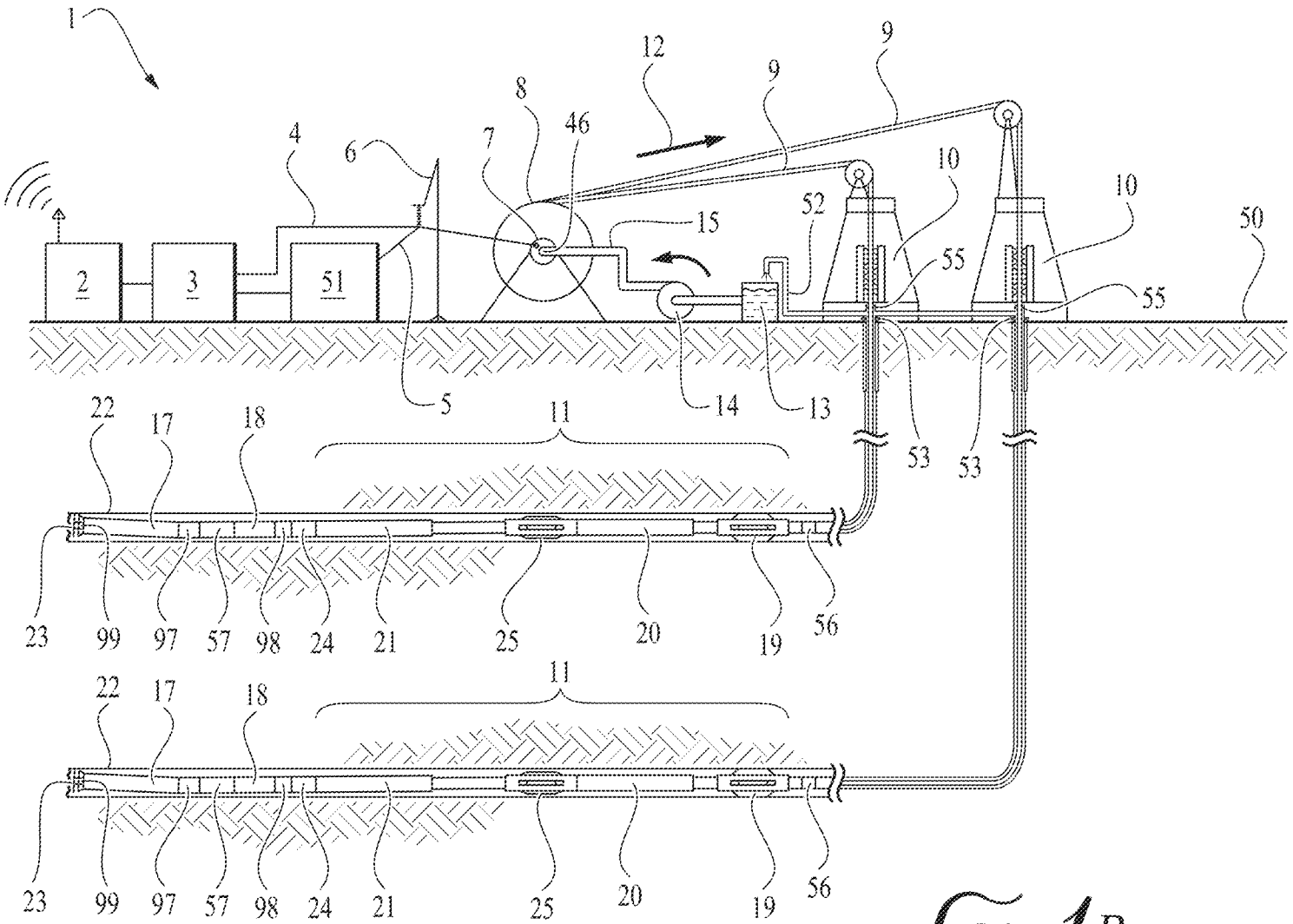
FIG. 1B is a schematic diagram of a pulse power umbilical drilling system, according to another embodiment.

Referring to FIG. 1B, in some embodiments, the system 1 may further comprise a second composite umbilical 9, wherein the winding system (e.g., the reel 8 or the carousel 40 (see FIG. 7)) is further configured to hold and dispense the second composite umbilical 9; a second surface feeder 10 configured to feed the second composite umbilical 9 from the winding system into a second wellbore 48; and/or a second bottom hole assembly 16 coupled to the second composite umbilical 9 and configured to receive power and a second communication signal via the composite umbilical 9. The second bottom hole assembly 16 may include a second tractor 11 and/or a second pulse power electrode 23 coupled to the second tractor 11. In some embodiments, the pulse power electrode 23 could be replaced with another component such as a milling tool, perforating gun, a sand vac, a bailer, or any other type of well work over or intervention section.

Figure 8:
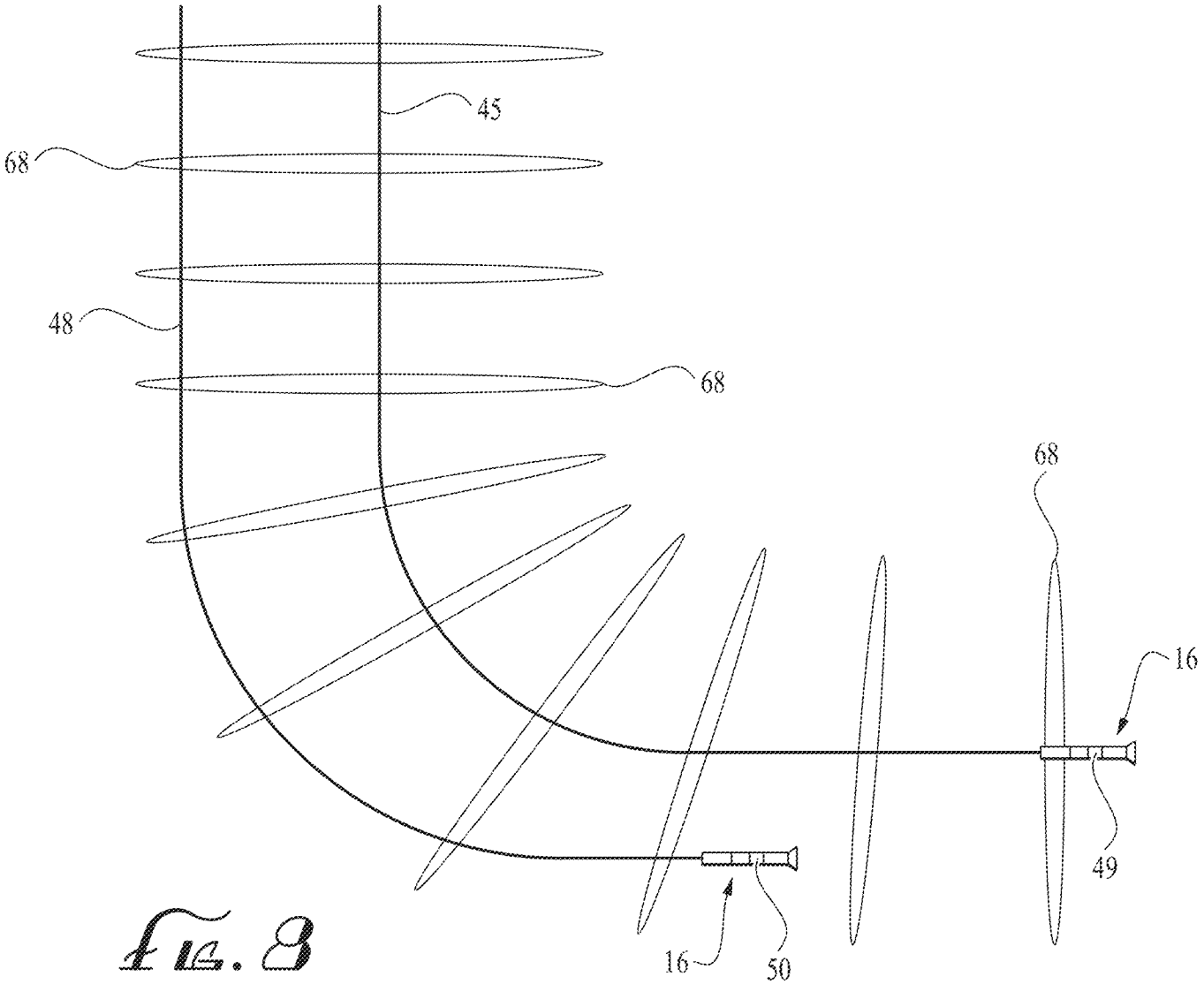
FIG. 8 is a schematic diagram of a drilling operation for a geothermal well, according to an embodiment.

Referring to FIGS. 1 and 7-8, the winding system may include a carousel 40. The carousel 40 may include a first tray 44 (e.g., the lower tray) configured to hold the first composite umbilical 9, and a second tray 44 (e.g., the middle tray) configured to hold the second composite umbilical 9. In some embodiments, the length of the first umbilical 9 in the first tray is sufficiently long to span the length of the entire first wellbore 45 and/or the length of the second umbilical 9 in the second tray 44 is sufficiently long to span the length of the entire length of the second wellbore 48. However, if there is insufficient length, a third umbilical 9 in a third tray 44 may be used (e.g., for connecting umbilicals 9 end-to-end). The third composite umbilical 9 may be configured to be joined to the first composite umbilical 9 or the second composite umbilical 9. An axis of rotation of the first tray 44 may be aligned with an axis of rotation of the second tray 44, which may be vertically oriented with respect to gravity. An axis of rotation of the third tray 44 may be aligned with the axis of rotation of the second tray 44. That is, all trays 44 may share a common axis of rotation 47.

In some embodiments, each tray 44 spins independently of each other. The feed rate of the respective tray 44 may be based on the movement of the tractor 11. For example, the tractor 11 may communicate a signal to a controller 3,24 or the controller 3,24 may otherwise determine the position of the tractor 11, and then the controller 3,24 may set the feed rate of the tray 44 corresponding to that particular tractor 11. The feed rate of each tray 44 may be controlled independently and may depend on the respective tractor 11. A constant tension may be maintained in the umbilicals 9. Tension may be controlled by the carousel 40, the surface feeder 10, and/or the tractor 11 (see FIG. 1). There may be one or motors that drive each tray 44 (e.g., controlled by the controller 3,24).

In some embodiments, the carousel 40 is 30, 40, 50, 60, 70, 80, 90, or 100 or more feet in diameter. Carousel 40 may be transported on a flat bed and set down in a single location for the life of the well. In some embodiments, the carousel 40 is transported in sections and assembled on site. In some embodiments, the carousel 40 may be used to bore multiple wellbores in succession within a given area without the need for it to be moved.

Figure 9A:
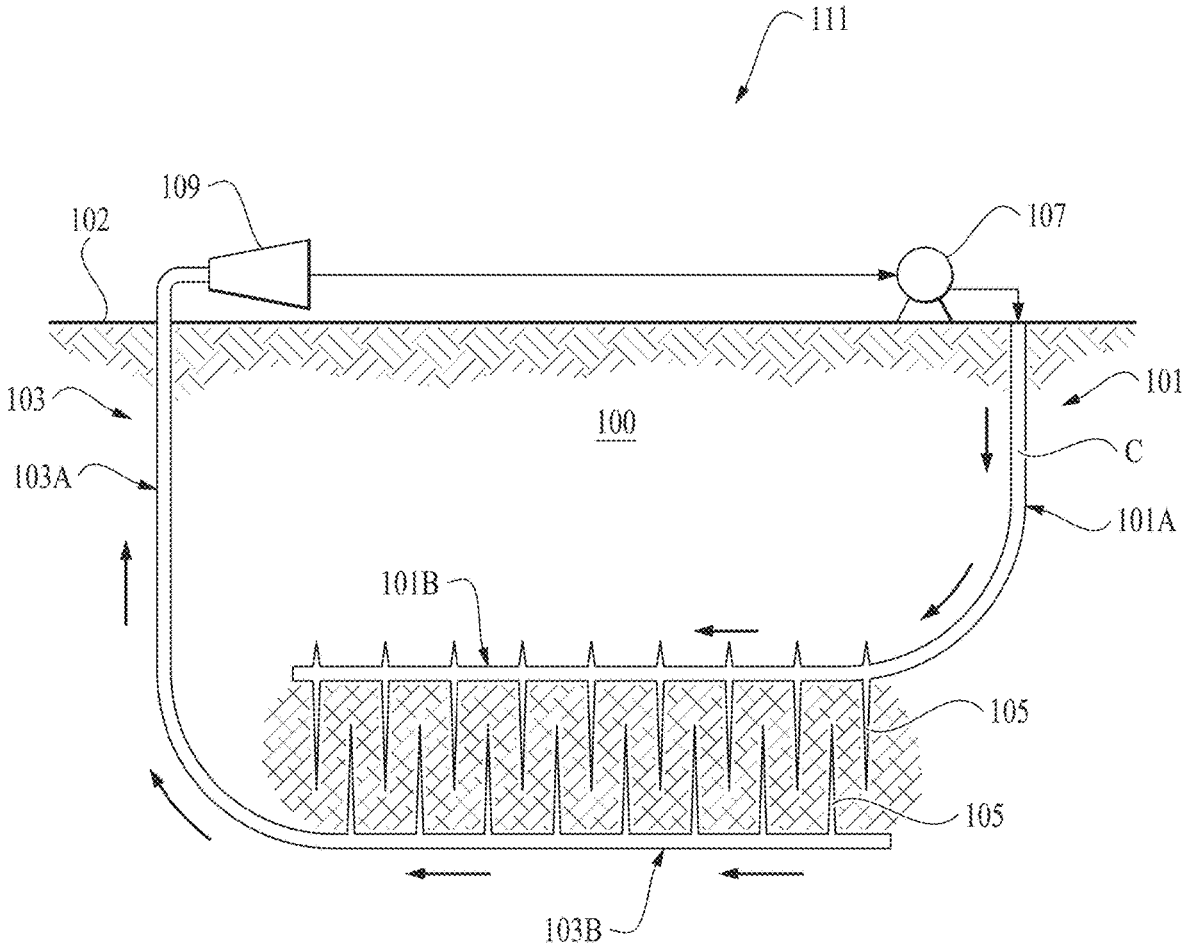
FIG. 9A is a schematic diagram of a geothermal well, according to an embodiment.
Figure 9B:
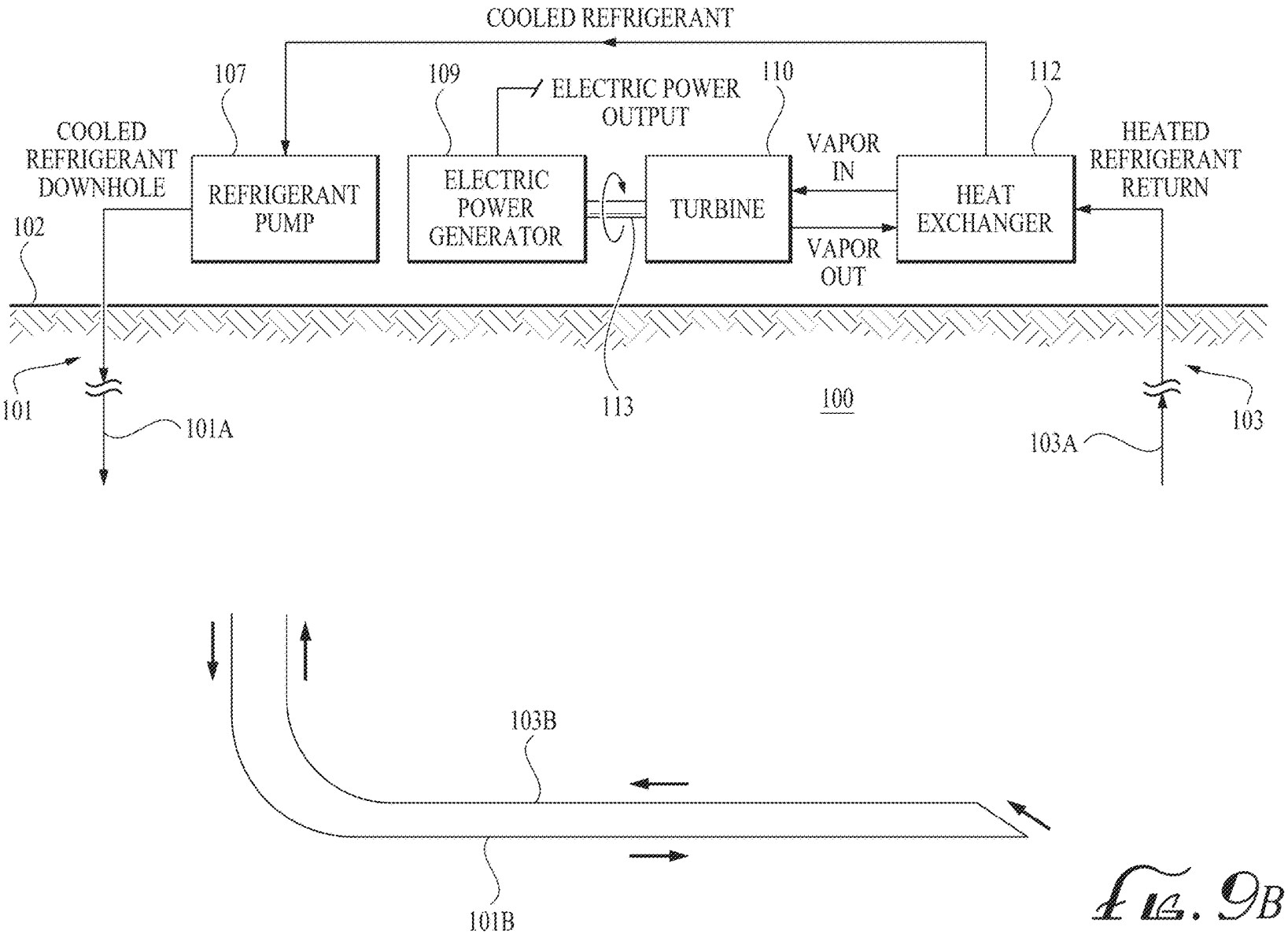
FIG. 9B is a schematic diagram of a geothermal well, according to another embodiment.

Referring to FIGS. 8-9, the first wellbore 45 may be an injection wellbore 101 of a geothermal well, the second wellbore 48 may be a production wellbore 103 of the geothermal well. The first bottom hole assembly 16 may include a ranging signal transmitter 49 configured to transmit a ranging signal, the second bottom hole 16 assembly may include a ranging signal receiver 50 configured to receive the ranging signal from the ranging signal transmitter 49. The second bottom hole assembly 16 may be configured to follow the first bottom hole assembly using the received signal (e.g., by using a magnetic field 68). For example, a controller may control the second bottom hole assembly 16 such that the second bottom hole assembly 16 stays within a distance range from the first bottom hole assembly 16. For example, magnetic ranging technologies may be used to determine the distance between the first bottom hole assembly 16 and the second bottom hole assembly 16. In some embodiments, the ranging technology is used to control the second bottom hole assembly 16 such that the second wellbore 48 connects with the first wellbore 45. In some embodiments, the first wellbore 45 connects with the second wellbore 48 (see FIG. 9B). In other embodiments, the first wellbore 45 does not connect with the second wellbore 48 but hydraulic fracturing is used to bring the first wellbore 45 and second wellbore 48 into fluid communication (see FIG. 9A).

Referring to FIG. 9, the system of the present disclosure may be configured to form wells of a geothermal power plant 111. The subterranean formation 100 may include a production wellbore 103 that has been drilled from the surface 102 to penetrate into the formation 100. The production wellbore 103 may include a vertical portion 103A extending from the surface 102 and a horizontal portion 103B extending from the bottom of the vertical portion 101A. The production wellbore 103 may be coupled to an electricity generator 109, for example, driven by a turbine 110 via a shaft 113. The subterranean formation 100 may also include an injection wellbore 101 that has been drilled from the surface 102 to penetrate into the formation 100. The injection wellbore 101 may include a vertical portion 101A extending from the surface 102 and a horizontal portion 101B extending from the bottom of the vertical portion 101A. Further, the injection wellbore 101 may be coupled to an injection pump 107 (e.g., a refrigerant pump). In some embodiments, the horizontal portion 103B of the production wellbore 103 may be parallel to the horizontal portion 101B of the injection wellbore 101. In some embodiments, the horizontal portion 101B of the injection wellbore 101 and the horizontal portion 103B of the production wellbore 103 may be within a range of 50 to 1000 feet of one another.

During a geothermal operation (e.g., running of the geothermal power plant 111), a circulating fluid C (flow of circulating fluid C indicated by arrows) comprising water may be injected into the injection wellbore 101, absorb heat from the formation 100, and be recovered from the production wellbore 103. In the embodiment of FIG. 9A, the circulating fluid C can circulate from the injection well 101 and, via adjacent fractures 105 associated with injection wellbore 101 and production wellbore 103, into the production wellbore 103. In the embodiment of FIG. 9B, the circulating fluid can flow directly from the injection well 101 to the production wellbore 103, which form a loop. After absorbing heat in the subterranean formation 100, the heated circulating fluid can exit the production wellbore 103. Heat can then be extracted from the circulating fluid C. In the embodiment of FIG. 9A, the heated circulating fluid C can be passed through the electricity generator 109 (e.g., one or more turbine generators) or associated components, wherein the heat can be utilized to produce electricity. In the embodiment of FIG. 9B, the circulating fluid C (e.g., water) may be run through a heat exchanger 112, which is associated with the electric generator 109. In the heat exchanger, the circulating fluid C (e.g., water) may transfer heat to a secondary fluid (e.g., isobutane or isopentane) with a lower boiling point than water. Due to the transfer of heat, the secondary fluid may vaporize and the vapor may drive the turbine 110. After the heat transfer, the relatively cool circulating fluid C can be pumped via an injection pump 107 back into the injection well 101. The electric generator 109 may be configured to provide electric power to a power grid.

Figure 10:
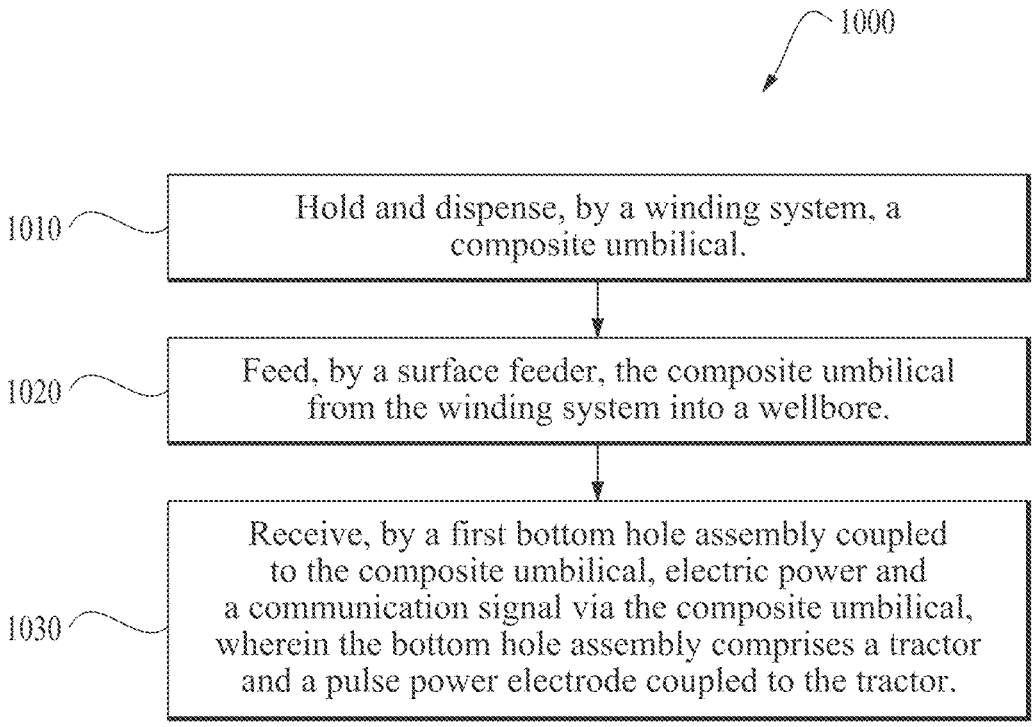
FIG. 10 is a flow diagram of an exemplary method of forming a well, according to an embodiment.

Referring to FIG. 10, a method 1000 for well formation may include the step 1010 of holding and dispensing, by a winding system, a first composite umbilical; the step 1020 of feeding, by a first surface feeder, the first composite umbilical from the winding system into a first wellbore; and the step 1030 of receiving, by a first bottom hole assembly coupled to the first composite umbilical, electric power and a first communication signal via the first composite umbilical, wherein the first bottom hole assembly comprises a first tractor and a first pulse power electrode coupled to the first tractor.

The composite umbilical may include an inner wrap; an outer wrap disposed concentrically around the inner wrap; a cable carrier layer disposed between the inner wrap and the outer wrap; power cables disposed in the cable carrier layer and configured to carry the electric power; and/or a communication cable disposed inside the cable carrier layer and configured to carry the first communication signal. The composite umbilical may include an inner wrap; an outer wrap disposed concentrically around the inner wrap; power cables coaxial with the inner wrap, disposed between the inner wrap and the outer wrap, and configured to carry the electric power; and a communication cable coaxial with the inner wrap, disposed between the inner wrap and the outer wrap, and configured to carry the first communication signal. The winding system may include a reel. An axis of rotation of the reel may be horizontally oriented with respect to gravity. The winding system may include a carousel. An axis of rotation of the carousel may be vertically oriented with respect to gravity.

The method 1000 may further include holding and dispensing, by the winding system, a second composite umbilical; feeding, by a second surface feeder, the second composite umbilical from the winding system into a second wellbore; and receiving, by a second bottom hole assembly coupled to the second composite umbilical, electric power and a second communication signal via the second composite umbilical. The second bottom hole assembly may include a second tractor and a second pulse power electrode coupled to the second tractor. The winding system may include a carousel. The carousel may include a first tray holding the first composite umbilical and a second tray holding the second composite umbilical. An axis of rotation of the first tray may be aligned with an axis of rotation of the second tray, which may be vertically oriented with respect to gravity.

The method 1000 may further include transmitting, by a ranging signal transmitter of the first bottom hole assembly, a ranging signal; receiving, by a ranging signal receiver of the second bottom hole assembly, the ranging signal from the ranging signal transmitter; and following, by the second bottom hole assembly, the first bottom hole assembly, using the received signal. The first wellbore may be an injection wellbore of a geothermal well, and the second wellbore may be a production wellbore of the geothermal well. The method 1000 may further include joining a third composite umbilical to the first composite umbilical or the second composite umbilical. The carousel may further include a third tray holding the third composite umbilical. An axis of rotation of the third tray may be aligned with the axis of rotation of the second tray.

The system and method of the present disclosure may present the advantage of saving space, for example, by having a single carousel with multiple stacks instead of numerous reels. The system and method of the present disclosure may also prevent down time by having multiple segments of umbilical on the same carousel tray. It may also present the advantage of being able to drill numerous wells in a given area (even up to a mile away) which are fed umbilical by the same carousel. There could be intermediate motors to help with feed over long distances. In some embodiments, the carousel could be a 50-year or more installation that could be restocked with umbilical over time.

ADDITIONAL DISCLOSURE

The following are non-limiting, specific embodiments in accordance with the present disclosure:

In a first embodiment, a system for well formation comprises a first composite umbilical; a winding system configured to hold and dispense the first composite umbilical; a first surface feeder configured to feed the first composite umbilical from the winding system into a first wellbore; and a first bottom hole assembly coupled to the first composite umbilical and configured to receive electric power and a first communication signal via the first composite umbilical, wherein the first bottom hole assembly comprises a first tractor and a first pulse power electrode coupled to the first tractor.

A second embodiment can include the system of the first embodiment, wherein the first composite umbilical comprises an inner wrap; and an outer wrap disposed concentrically around the inner wrap.

A third embodiment can include the system of the first or second embodiments, wherein the first composite umbilical further comprises a cable carrier layer disposed between the inner wrap and the outer wrap; power cables disposed inside the cable carrier layer and configured to carry the electric power; and a communication cable disposed inside the cable carrier layer and configured to carry the first communication signal.

A fourth embodiment can include the system of any of the first through third embodiments, wherein the first composite umbilical comprises an inner wrap; an outer wrap disposed concentrically around the inner wrap; power cables coaxial with the inner wrap, disposed between the inner wrap and the outer wrap, and configured to carry the electric power; and a communication cable coaxial with the inner wrap, disposed between the inner wrap and the outer wrap, and configured to carry the first communication signal.

A fifth embodiment can include the system of any of the first through fourth embodiments, wherein the winding system comprises a reel, and an axis of rotation of the reel is horizontally oriented with respect to gravity.

A sixth embodiment can include the system of any of the first through fifth embodiments, wherein the winding system comprises a carousel, and an axis of rotation of the carousel is vertically oriented with respect to gravity.

A seventh embodiment can include the system of any of the first through sixth embodiments, further comprising a second composite umbilical, wherein the winding system is further configured to hold and dispense the second composite umbilical; a second surface feeder configured to feed the second composite umbilical from the winding system into a second wellbore; and a second bottom hole assembly coupled to the second composite umbilical and configured to receive power and a second communication signal via the second composite umbilical, wherein the second bottom hole assembly comprises a second tractor and a second pulse power electrode coupled to the second tractor.

An eighth embodiment can include the system of any of the first through seventh embodiments, wherein the winding system comprises a carousel, the carousel comprises a first tray configured to hold the first composite umbilical, and a second tray configured to hold the second composite umbilical, and an axis of rotation of the first tray is aligned with an axis of rotation of the second tray, which is vertically oriented with respect to gravity.

A ninth embodiment can include the system of any of the first through eighth embodiments, wherein the first wellbore is an injection wellbore of a geothermal well, the second wellbore is a production wellbore of the geothermal well, the first bottom hole assembly comprises a ranging signal transmitter configured to transmit a ranging signal, the second bottom hole assembly comprises a ranging signal receiver configured to receive the ranging signal from the ranging signal transmitter, and the second bottom hole assembly is configured to follow the first bottom hole assembly using the received signal.

A tenth embodiment can include the system of any of the first through ninth embodiments, further comprising a third composite umbilical configured to be joined to the first composite umbilical or the second composite umbilical, wherein the carousel further comprises a third tray configured to hold the third composite umbilical, and wherein an axis of rotation of the third tray is aligned with the axis of rotation of the second tray.

In an eleventh embodiment, a method for well formation comprises holding and dispensing, by a winding system, a first composite umbilical; feeding, by a first surface feeder, the first composite umbilical from the winding system into a first wellbore; and receiving, by a first bottom hole assembly coupled to the first composite umbilical, electric power and a first communication signal via the first composite umbilical, wherein the first bottom hole assembly comprises a first tractor and a first pulse power electrode coupled to the first tractor.

A twelfth embodiment can include the method of the eleventh embodiment, wherein the first composite umbilical comprises an inner wrap; and an outer wrap disposed concentrically around the inner wrap.

A thirteenth embodiment can include the method of the eleventh or twelfth embodiments, wherein the first composite umbilical further comprises a cable carrier layer disposed between the inner wrap and the outer wrap; power cables disposed inside the cable carrier layer and configured to carry the electric power; and a communication cable disposed inside the cable carrier layer and configured to carry the first communication signal.

A fourteenth embodiment can include the method of any of the eleventh through thirteenth embodiments, wherein the first composite umbilical comprises an inner wrap; an outer wrap disposed concentrically around the inner wrap; power cables coaxial with the inner wrap, disposed between the inner wrap and the outer wrap, and configured to carry the electric power; and a communication cable coaxial with the inner wrap, disposed between the inner wrap and the outer wrap, and configured to carry the first communication signal.

A fifteenth embodiment can include the method of any of the eleventh through fourteenth embodiments, wherein the winding system comprises a reel, and an axis of rotation of the reel is horizontally oriented with respect to gravity.

A sixteenth embodiment can include the method of any of the eleventh through fifteenth embodiments, wherein the winding system comprises a carousel, and an axis of rotation of the carousel is vertically oriented with respect to gravity.

A seventeenth embodiment can include the method of any of the eleventh through sixteenth embodiments, further comprising holding and dispensing, by the winding system, a second composite umbilical; feeding, by a second surface feeder, the second composite umbilical from the winding system into a second wellbore; and receiving, by a second bottom hole assembly coupled to the second composite umbilical, electric power and a second communication signal via the second composite umbilical, wherein the second bottom hole assembly comprises a second tractor and a second pulse power electrode coupled to the second tractor.

An eighteenth embodiment can include the method of any of the eleventh through seventeenth embodiments, wherein the winding system comprises a carousel, the carousel comprises a first tray holding the first composite umbilical, and a second tray holding the second composite umbilical, and an axis of rotation of the first tray is aligned with an axis of rotation of the second tray, which is vertically oriented with respect to gravity.

A nineteenth embodiment can include the method of any of the eleventh through eighteenth embodiments, further comprising transmitting, by a ranging signal transmitter of the first bottom hole assembly, a ranging signal; receiving, by a ranging signal receiver of the second bottom hole assembly, the ranging signal from the ranging signal transmitter; and following, by the second bottom hole assembly, the first bottom hole assembly, using the received signal, wherein the first wellbore is an injection wellbore of a geothermal well, and wherein the second wellbore is a production wellbore of the geothermal well.

A twentieth embodiment can include the method of any of the eleventh through nineteenth embodiments, further comprising joining a third composite umbilical to the first composite umbilical or the second composite umbilical, wherein the carousel further comprises a third tray holding the third composite umbilical, and wherein an axis of rotation of the third tray is aligned with the axis of rotation of the second tray.

While embodiments have been shown and described, modifications thereof can be made by one skilled in the art without departing from the spirit and teachings of this disclosure. The embodiments described herein are exemplary only and are not intended to be limiting. Many variations and modifications of the embodiments disclosed herein are possible and are within the scope of this disclosure. For example, the various elements or components may be combined or integrated in another system or certain features may be omitted or not implemented. Also, techniques, systems, subsystems, and methods described and illustrated in the various embodiments as discrete or separate may be combined or integrated with other techniques, systems, subsystems, or methods without departing from the scope of this disclosure. Other items shown or discussed as directly coupled or connected or communicating with each other may be indirectly coupled, connected, or communicated with. Method or process steps set forth may be performed in a different order. The use of terms, such as "first," "second," "third" or "fourth" to describe various processes or structures is only used as a shorthand reference to such steps/structures and does not necessarily imply that such steps/structures are performed/formed in that ordered sequence (unless such requirement is clearly stated explicitly in the specification).

Where numerical ranges or limitations are expressly stated, such express ranges or limitations should be understood to include iterative ranges or limitations of like magnitude falling within the expressly stated ranges or limitations. For example, whenever a numerical range with a lower limit, $R_1$, and an upper limit, $R_u$, is disclosed, any number falling within the range is specifically disclosed. In particular, the following numbers within the range are specifically disclosed: $R=R_1+k*(R_u-R_1)$, wherein k is a variable ranging from 1 percent to 100 percent with a 1 percent increment, i.e., k is 1 percent, 2 percent, 3 percent, 4 percent, 5 percent . . . 50 percent, 51 percent, 52 percent . . . 95 percent, 96 percent, 97 percent, 98 percent, 99 percent, or 100 percent. Moreover, any numerical range defined by two R numbers as defined in the above is also specifically disclosed. Language of degree used herein, such as "approximately," "about," "generally," and "substantially," represent a value, amount, or characteristic close to the stated value, amount, or characteristic that still performs a desired function or achieves a desired result. For example, the language of degree may mean a range of values as understood by a person of skill or, otherwise, an amount that is +/−10%.

Disclosure of a singular element should be understood to provide support for a plurality of the element. It is contemplated that elements of the present disclosure may be duplicated in any suitable quantity.

Use of broader terms such as comprises, includes, having, etc. should be understood to provide support for narrower terms such as consisting of, consisting essentially of, comprised substantially of, etc. The use of terms such as "high-pressure" and "low-pressure" is intended to only be descriptive of the component and their position within the systems disclosed herein. That is, the use of such terms should not be understood to imply that there is a specific operating pressure or pressure rating for such components. For example, the term "high-pressure" describing a manifold should be understood to refer to a manifold that receives pressurized fluid that has been discharged from a pump irrespective of the actual pressure of the fluid as it leaves the pump or enters the manifold. Similarly, the term "low-pressure" describing a manifold should be understood to refer to a manifold that receives fluid and supplies that fluid to the suction side of the pump irrespective of the actual pressure of the fluid within the low-pressure manifold.

Accordingly, the scope of protection is not limited by the description set out above but is only limited by the claims which follow, that scope including all equivalents of the subject matter of the claims. Each and every claim is incorporated into the specification as embodiments of the present disclosure. Thus, the claims are a further description and are an addition to the embodiments of the present disclosure. Any discussion of a reference herein is not an admission that it is prior art. Any disclosures of all patents, patent applications, and/or publications cited herein are hereby incorporated by reference, to the extent that they provide exemplary, procedural, or other details supplementary to those set forth herein.

As used herein, the term "or" does not require selection of only one element. Thus, the phrase "A or B" is satisfied by either one or both elements from the set {A, B}. A clause that recites "A or B" can be infringed with only one of the listed items, both of the listed items, multiples of the listed items, and one or both of the listed items and another item not listed. The phrase "A, B, or C" is satisfied by any one or any combination of any two or more from the set {A, B, C}. A clause that recites "A, B, or C" can be infringed with only one of the listed items, multiples of the listed items, and one or more of the items from the list and another item not listed.

As used herein, the article "a" means "one or more." As used herein, the article "an" means "one or more." As used herein, the article "the" when referring to a singular noun means "the one or more." Thus, the phrase "an element" means "one or more elements;" and the phrase "the element" means "the one or more elements."

As used herein, the term "and/or" includes any combination of the elements associated with the "and/or" term. Thus, the phrase "A, B, and/or C" includes any of A alone, B alone, C alone, A and B together, B and C together, A and C together, or A, B, and C together.

What is claimed is:

1. A system for well formation, comprising:

a first composite umbilical;

a winding system configured to hold and dispense the first composite umbilical;

a first surface feeder configured to feed the first composite umbilical from the winding system into a first wellbore;

a first bottom hole assembly coupled to the first composite umbilical and configured to receive electric power and a first communication signal via the first composite umbilical, wherein the first bottom hole assembly comprises a first tractor and a first pulse power electrode coupled to the first tractor;

a second composite umbilical, wherein the winding system is further configured to hold and dispense the second composite umbilical;

a second surface feeder configured to feed the second composite umbilical from the winding system into a second wellbore; and a second bottom hole assembly coupled to the second composite umbilical and configured to receive power and a second communication signal via the second composite umbilical, wherein the second bottom hole assembly comprises a second tractor and a second pulse power electrode coupled to the second tractor;

wherein:

the winding system comprises a carousel, the carousel comprises a first tray configured to hold the first composite umbilical, and a second tray configured to hold the second composite umbilical, and an axis of rotation of the first tray is aligned with an axis of rotation of the second tray, which is vertically oriented with respect to gravity.

2. The system of claim 1, wherein the first wellbore is an injection wellbore of a geothermal power plant, the second wellbore is a production wellbore of the geothermal power plant, the first bottom hole assembly comprises a ranging signal transmitter configured to transmit a ranging signal, the second bottom hole assembly comprises a ranging signal receiver configured to receive the ranging signal from the ranging signal transmitter, and the second bottom hole assembly is configured to follow the first bottom hole assembly using the received signal.

3. The system of claim 1, further comprising a third composite umbilical configured to be joined to the first composite umbilical or the second composite umbilical, wherein the carousel further comprises a third tray configured to hold the third composite umbilical, and wherein an axis of rotation of the third tray is aligned with the axis of rotation of the second tray.

4. A method for well formation, comprising:

holding and dispensing, by a winding system, a first composite umbilical;

feeding, by a first surface feeder, the first composite umbilical from the winding system into a first wellbore; and receiving, by a first bottom hole assembly coupled to the first composite umbilical, electric power and a first communication signal via the first composite umbilical, wherein the first bottom hole assembly comprises a first tractor and a first pulse power electrode coupled to the first tractor;

holding and dispensing, by the winding system, a s second composite umbilical;

feeding, by a second feeder, the second composite umbilical from the winding system into a second wellbore; and receiving by a second bottom hole assembly coupled to the second composite umbilical, electric power and a second communication signal via the second composite umbilical, wherein the second bottom hole assembly comprises a second tractor and a second pulse power electrode coupled to the second tractor, wherein the winding system comprises a carousel, wherein the carousel comprises a first tray holding the first composite umbilical, and a second tray holding the second composite umbilical, wherein an axis of rotation of the first tray is aligned with an axis of rotation of the second tray, which is vertically oriented with respect to gravity, wherein the first composite umbilical comprises:

an inner wrap; and an outer wrap disposed concentrically around the inner wrap;

a cable carrier layer having a wall which is disposed between the inner wrap and the outer wrap;

power cables embedded in the wall of the cable carrier layer and configured to carry the electric power that is received by the first bottom bole assembly; and a communication cable embedded in the wall of the cable carrier layer and configured to carry the first communication signal that is received by the first bottom hole assembly.

5. The method of claim 4, wherein the carousel further comprises a third tray holding a third composite umbilical.

6. The method of claim 4, wherein an axis of rotation of the carousel is vertically oriented with respect to gravity.

7. The method of claim 4, further comprising:

transmitting, by a ranging signal transmitter of the first bottom hole assembly, a ranging signal;

receiving, by a ranging signal receiver of the second bottom hole assembly, the ranging signal from the ranging signal transmitter; and following, by the second bottom hole assembly, the first bottom hole assembly, using the received signal, wherein the first wellbore is an injection wellbore of a geothermal power plant, and wherein the second wellbore is a production wellbore of the geothermal power plant.

8. The method of claim 4, further comprising joining a third composite umbilical to the first composite umbilical or the second composite umbilical, wherein the carousel further comprises a third tray holding the third composite umbilical, and wherein an axis of rotation of the third tray is aligned with the axis of rotation of the second tray.

9. The method of claim 4, wherein an axis of rotation of the carousel is vertically oriented with respect to gravity.

10. The method of claim 4, wherein the inner wrap comprises a ceramic impregnated composite.

11. The method of claim 10, wherein the impregnated composite comprises a carbon fiber matrix impregnated with ceramic particles.

12. The method of claim 4, wherein the first composite umbilical does not rotate.

13. The method of claim 4, further comprising using the first pulse power electrode to bore the first wellbore, wherein the first composite umbilical does not rotate.

14. The method of claim 4, wherein the outer wrap comprises a ceramic impregnated composite.

15. The method of claim 14, wherein the impregnated composite comprises a carbon fiber matrix impregnated with ceramic particles.

16. The method of claim 4, further comprising holding and dispensing, by the winding system, a third composite umbilical.

17. The method of claim 16, further comprising feeding, by a third surface feeder, the third composite umbilical from the winding system into a third wellbore.

18. The method of claim 17, further comprising receiving, by a third bottom hole assembly coupled to the third composite umbilical, electric power and a third communication signal via the third composite umbilical.

19. The method of claim 18, wherein the third bottom hole assembly comprises a third tractor and a third pulse power electrode coupled to the third tractor.

20. The method of claim 19, wherein the carousel further comprises a third tray holding the third composite umbilical.

* * * * *